US008422925B2

(12) United States Patent
Fujita et al.

(10) Patent No.: US 8,422,925 B2
(45) Date of Patent: Apr. 16, 2013

(54) TRANSFER-FIXING DEVICE AND IMAGE FORMING APPARATUS INCORPORATING SAME

(75) Inventors: Takashi Fujita, Kanagawa (JP); Atsushi Nagata, Kanagawa (JP); Takashi Seto, Kanagawa (JP); Hiromitsu Takagaki, Kanagawa (JP); Kazuya Saito, Kanagawa (JP); Takeshi Yamamoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 366 days.

(21) Appl. No.: 12/659,683

(22) Filed: Mar. 17, 2010

(65) Prior Publication Data

US 2010/0239292 A1 Sep. 23, 2010

(30) Foreign Application Priority Data

Mar. 17, 2009 (JP) ..... 2009-063712
Mar. 28, 2009 (JP) ..... 2009-080684
Jul. 7, 2009 (JP) ..... 2009-161181

(51) Int. Cl.
*G03G 15/16* (2006.01)

(52) U.S. Cl.
USPC ..... 399/307

(58) Field of Classification Search ..... 399/148, 399/307, 390
See application file for complete search history.

(56) References Cited

U.S. PATENT DOCUMENTS 4,812,873 A * 3/1989 Inagaki et al. ..... 399/331
6,002,891 A * 12/1999 Shin ..... 399/45
7,031,648 B2 4/2006 Takashi et al.
7,127,202 B2 10/2006 Fujita et al.
7,233,762 B2 6/2007 Kunii et al.
7,254,362 B2 8/2007 Kikuchi et al.
7,269,384 B2 9/2007 Someya et al.
7,299,003 B2 11/2007 Kurotaka et al.
7,359,666 B2 4/2008 Takashi et al.
7,369,803 B2 5/2008 Echigo et al.

(Continued)

FOREIGN PATENT DOCUMENTS

JP 03-063756 3/1991
JP 07-019668 3/1995

(Continued)

OTHER PUBLICATIONS

Abstract of JP 11-065330 published on Mar. 5, 1999.

(Continued)

*Primary Examiner* — David Gray
*Assistant Examiner* — Gregory H Curran
(74) *Attorney, Agent, or Firm* — Harness, Dickey & Pierce, P.L.C.

(57) ABSTRACT

In a transfer-fixing device for transferring and fixing a toner image on a transfer-fixing side of a recording medium, a transfer-fixing member carries the toner image. A pressing member presses against the transfer-fixing member to form a nip between the transfer-fixing member and the pressing member through which the recording medium passes. A heat transmission member is provided upstream from the nip in a recording medium conveyance direction to heat the transfer-fixing side of the recording medium while guiding the recording medium to the nip. A heating member is connected to the heat transmission member to heat the heat transmission member. A biasing member biases the recording medium guided by the heat transmission member against the heat transmission member.

17 Claims, 14 Drawing Sheets

U.S. PATENT DOCUMENTS

| | | | | |
|---|---|---|---|---|
| 7,427,727 | B2 | 9/2008 | Koide et al. | |
| 7,526,242 | B2 | 4/2009 | Takagaki et al. | |
| 7,551,882 | B2 | 6/2009 | Seto et al. | |
| 7,583,922 | B2 | 9/2009 | Takashi et al. | |
| 7,613,419 | B2 | 11/2009 | Suzuki et al. | |
| 7,643,767 | B2 | 1/2010 | Seto et al. | |
| 2004/0037595 | A1 | 2/2004 | Takashi et al. | |
| 2005/0025534 | A1 | 2/2005 | Fujita et al. | |
| 2005/0152721 | A1 | 7/2005 | Kikuchi et al. | |
| 2005/0201783 | A1 | 9/2005 | Kurotaka et al. | |
| 2005/0207801 | A1 | 9/2005 | Kunii et al. | |
| 2006/0008302 | A1 | 1/2006 | Someya et al. | |
| 2006/0013624 | A1 | 1/2006 | Kurotaka et al. | |
| 2006/0120776 | A1 | 6/2006 | Takashi et al. | |
| 2006/0140689 | A1 | 6/2006 | Echigo et al. | |
| 2007/0012676 | A1 | 1/2007 | Koide et al. | |
| 2007/0065188 | A1 | 3/2007 | Takagaki et al. | |
| 2007/0071511 | A1 | 3/2007 | Suzuki et al. | |
| 2007/0212126 | A1 | 9/2007 | Seto et al. | |
| 2007/0212129 | A1 | 9/2007 | Takemoto et al. | |
| 2007/0218386 | A1 | 9/2007 | Suzuki et al. | |
| 2007/0248388 | A1* | 10/2007 | Tsueda et al. | 399/328 |
| 2008/0008505 | A1 | 1/2008 | Seto et al. | |
| 2008/0069606 | A1 | 3/2008 | Yamashita et al. | |
| 2008/0069610 | A1 | 3/2008 | Nakafuji et al. | |
| 2008/0199229 | A1 | 8/2008 | Fujita et al. | |
| 2008/0219716 | A1 | 9/2008 | Takashi et al. | |
| 2008/0219717 | A1 | 9/2008 | Kayahara et al. | |
| 2008/0219718 | A1 | 9/2008 | Fujita et al. | |
| 2008/0292347 | A1 | 11/2008 | Koide et al. | |
| 2009/0003898 | A1 | 1/2009 | Kayahara et al. | |
| 2009/0016786 | A1 | 1/2009 | Suzuki et al. | |
| 2009/0116880 | A1 | 5/2009 | Takagaki et al. | |
| 2010/0014903 | A1 | 1/2010 | Seto et al. | |
| 2010/0232844 | A1* | 9/2010 | Saito et al. | 399/307 |

FOREIGN PATENT DOCUMENTS

| | | |
|---|---|---|
| JP | 09-179373 | 7/1997 |
| JP | 2706522 | 10/1997 |
| JP | 2002-099159 | 4/2002 |
| JP | 2004-145260 | 5/2004 |
| JP | 3610737 | 10/2004 |
| JP | 2005-037879 | 2/2005 |

OTHER PUBLICATIONS

Abstract of JP 64-000698 published on Jan. 5, 1989.
Abstract of JP 03-063757 published on Mar. 19, 1991.

* cited by examiner

TRANSFER-FIXING DEVICE AND IMAGE FORMING APPARATUS INCORPORATING SAME

PRIORITY STATEMENT

The present patent application claims priority from Japanese Patent Application Nos. 2009-063712, filed on Mar. 17, 2009, 2009-080684, filed on Mar. 28, 2009, and 2009-161181, filed on Jul. 7, 2009 in the Japan Patent Office, each of which is hereby incorporated herein by reference in its entirety.

BACKGROUND OF THE INVENTION

1. Field of the Invention

Example embodiments generally relate to a transfer-fixing device and an image forming apparatus, and more particularly, to a transfer-fixing device for transferring and fixing a toner image on a recording medium and an image forming apparatus including the transfer-fixing device.

2. Description of the Related Art

Related-art image forming apparatuses, such as copiers, facsimile machines, printers, or multifunction printers having at least one of copying, printing, scanning, and facsimile functions, typically form an image on a recording medium according to image data. Thus, for example, a charger uniformly charges a surface of an image carrier; an optical writer emits a light beam onto the charged surface of the image carrier to form an electrostatic latent image on the image carrier according to the image data; a development device supplies toner to the electrostatic latent image formed on the image carrier to make the electrostatic latent image visible as a toner image; a transfer device transfers the toner image formed on the image carrier onto an intermediate transfer member; a transfer-fixing device transfers and fixes the toner image from the intermediate transfer member onto a recording medium, thus forming the image on the recording medium.

One benefit of such transfer-fixing device is its ability to transfer and fix the toner image properly even on rough recording media. Specifically, the transfer-fixing device applies heat to the toner image to melt and fix the toner image on the recording medium concurrently with transferring the toner image formed on the intermediate transfer member onto the recording medium. Accordingly, even when the rough recording medium passes over the intermediate transfer member and slight gaps are formed between the recording medium surface and the intermediate transfer member due to surface asperities of the recording medium, the heat applied by the transfer-fixing device to the toner image softens and melts toner of the toner image into viscous blocks that are then transferred onto the recording medium. By contrast, in image forming apparatuses that include separate transfer and fixing devices, in which the fixing device fixes the toner image after the transfer device transfers the toner image from the intermediate transfer member onto the rough recording medium, abnormal discharge may occur in the slight gaps formed between the surface of the rough recording medium and the intermediate transfer member. Consequently, the toner image may not be transferred from the intermediate transfer member onto the rough recording medium properly, resulting in formation of a faulty, rough image.

However, the intermediate transfer member of the transfer-fixing device is long and thick, thus degrading heating efficiency for heating the intermediate transfer member and increasing energy consumption. Moreover, the intermediate transfer member needs to be cooled after the transfer-fixing process to prevent the heated intermediate transfer member from damaging the image carrier contacting the intermediate transfer member. Such repeated heating and cooling processes may increase energy consumption.

SUMMARY

At least one embodiment may provide a transfer-fixing device for transferring and fixing a toner image on a transfer-fixing side of a recording medium. The transfer-fixing device includes a transfer-fixing member, a pressing member, a heat transmission member, a heating member, and a biasing member. The transfer-fixing member carries the toner image. The pressing member presses against the transfer-fixing member to form a nip between the transfer-fixing member and the pressing member through which the recording medium passes. The heat transmission member is provided upstream from the nip in a recording medium conveyance direction to heat the transfer-fixing side of the recording medium while guiding the recording medium to the nip. The heating member is connected to the heat transmission member to heat the heat transmission member. The biasing member biases the recording medium guided by the heat transmission member against the heat transmission member.

At least one embodiment may provide an image forming apparatus including the transfer-fixing device described above.

Additional features and advantages of example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1:
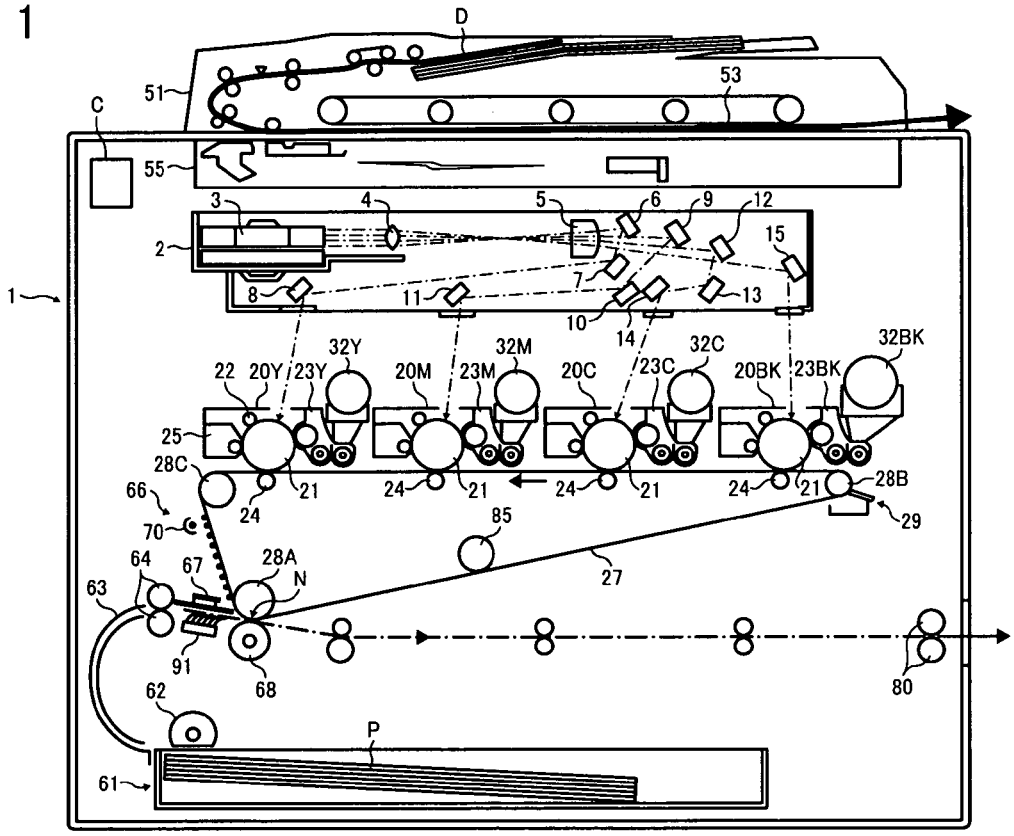
FIG. 1 is a schematic view of an image forming apparatus according to an example embodiment.

The accompanying drawings are intended to depict example embodiments and should not be interpreted to limit the scope thereof. The accompanying drawings are not to be considered as drawn to scale unless explicitly noted.

DETAILED DESCRIPTION OF EXAMPLE EMBODIMENTS

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, particularly to FIG. 1, an image forming apparatus 1 according to an example embodiment is explained.

FIG. 1 is a schematic view of the image forming apparatus 1. As illustrated in FIG. 1, the image forming apparatus 1 includes a writer 2, process cartridges 20Y, 20M, 20C, and 20BK, transfer bias rollers 24, rollers 28A, 28B, and 28C, a belt cleaner 29, toner suppliers 32Y, 32M, 32C, and 32BK, a document feeder 51, a reader 55, a paper tray 61, a feed roller 62, a conveyance guide 63, a registration roller pair 64, a transfer-fixing device 66, a heater 70, an output roller pair 80, and a controller C.

The writer 2 includes a polygon mirror 3, lenses 4 and 5, and mirrors 6 to 15.

The process cartridges 20Y, 20M, 20C, and 20BK include photoconductive drums 21, chargers 22, development devices 23Y, 23M, 23C, and 23BK, and cleaners 25, respectively.

The reader 55 includes an exposure glass 53.

The transfer-fixing device 66 includes a transfer-fixing belt 27, a heating device 67, a pressing roller 68, an equalization roller 85, and a brush member 91.

Figure 2:
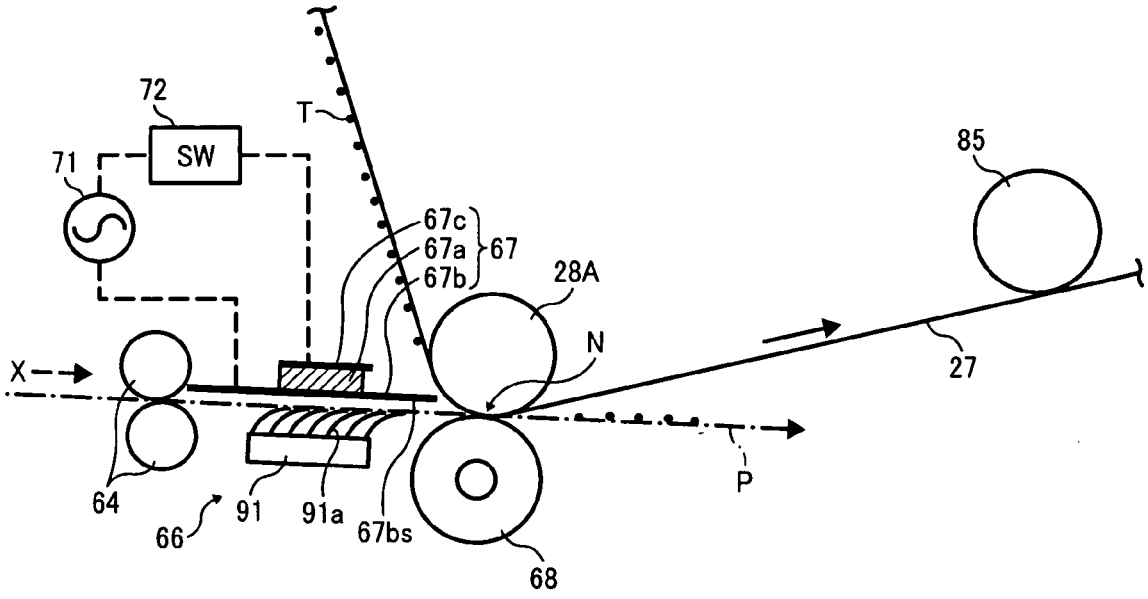
FIG. 2 is a sectional view (according to an example embodiment) of a transfer-fixing device included in the image forming apparatus shown in FIG. 1.

FIG. 2 is a sectional view of the transfer-fixing device 66. As illustrated in FIG. 2, the transfer-fixing device 66 further includes an alternator 71 and a switch 72.

The heating device 67 includes a heating member 67*a*, a heat transmission plate 67*b*, and an electrode 67*c*. The heat transmission plate 67*b* includes a guide surface portion 67*bs*. The brush member 91 includes bristles 91*a*.

Figure 3:
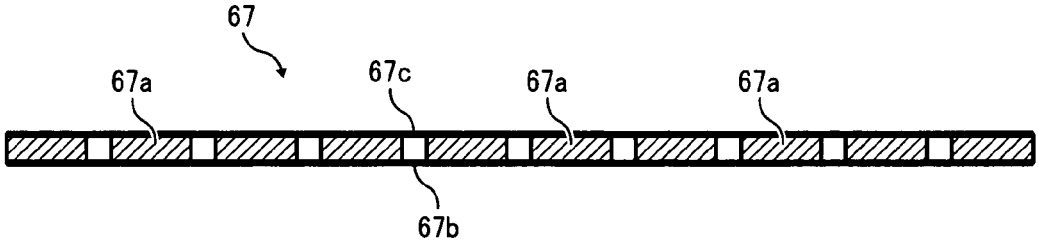
FIG. 3 is a sectional view (according to an example embodiment) of a heating device included in the transfer-fixing device shown in FIG. 2 in a width direction of the heating device seen in a direction X in FIG. 2.

FIG. 3 is a sectional view of the heating device 67 in a width direction of the heating device 67 seen in a direction X in FIG. 2.

As illustrated in FIG. 1, the image forming apparatus 1 may be a copier, a facsimile machine, a printer, a multifunction printer having at least one of copying, printing, scanning, plotter, and facsimile functions, or the like. The image forming apparatus 1 may form a color image and/or a monochrome image by electrophotography. According to this example embodiment, the image forming apparatus 1 functions as a copier for forming a color image on a recording medium by electrophotography.

In the image forming apparatus 1, the writer 2 serves as an exposure device for emitting laser beams onto the photoconductive drums 21 according to image data to form electrostatic latent images, respectively. The process cartridges 20Y, 20M, 20C, and 20BK form yellow, magenta, cyan, and black toner images, respectively. The photoconductive drums 21 serve as image carriers included in the process cartridges 20Y, 20M, 20C, and 20BK, respectively. The chargers 22 charge surfaces of the photoconductive drums 21, respectively. The development devices 23Y, 23M, 23C, and 23BK develop electrostatic latent images formed on the photoconductive drums 21 into yellow, magenta, cyan, and black toner images, respectively. The transfer bias rollers 24 transfer the yellow, magenta, cyan, and black toner images formed on the photoconductive drums 21 onto the transfer-fixing belt 27, respectively. The cleaners 25 remove residual toner not transferred and therefore remaining on the photoconductive drums 21 from the photoconductive drums 21, respectively.

The transfer-fixing belt 27 serves as a transfer-fixing member on which the yellow, magenta, cyan, and black toner images are transferred and superimposed to form a color toner image. The belt cleaner 29 serves as a cleaner for cleaning the transfer-fixing belt 27 after a transfer-fixing process. The toner suppliers 32Y, 32M, 32C, and 32BK supply yellow, magenta, cyan, and black toner to the development devices 23Y, 23M, 23C, and 23BK, respectively. The document feeder 51 feeds original documents D to the reader 55. The reader 55 reads an image on an original document D. The paper tray 61 contains recording media (e.g., transfer sheets). The transfer-fixing device 66 transfers and fixes the color toner image formed on the transfer-fixing belt 27 onto a recording medium P. The heating device 67 heats the recording medium P immediately before the transfer-fixing process. The pressing roller 68 serves as a pressing member pressing against the transfer-fixing belt 27 to form a nip N. The heater 70 heats the transfer-fixing belt 27. The equalization roller 85 equalizes a temperature distribution on the transfer-fixing belt 27 in a width direction of the transfer-fixing belt 27, and also serves as a cooling member for cooling the transfer-fixing belt 27. The brush member 91 serves as a biasing member for pressing the recording medium P against the heating device 67.

The transfer-fixing device 66 includes the transfer-fixing belt 27 serving as a transfer-fixing member, the heating device 67 serving as a heater, the pressing roller 68 serving as a pressing member, the heater 70, the equalization roller 85, and the brush member 91 serving as a biasing member. Alternatively, the transfer-fixing device 66 may not include the heater 70.

In each of the process cartridges 20Y, 20M, 20C, and 20BK, the photoconductive drum 21, the charger 22, and the cleaner 25 are integrated into a unit. In the process cartridges 20Y, 20M, 20C, and 20BK, yellow, magenta, cyan, and black toner images are formed on the photoconductive drums 21, respectively.

Referring to FIG. 1, the following describes color image forming operations performed in the image forming apparatus 1.

Conveyance rollers of the document feeder 51 convey an original document D placed on an original document tray in a direction shown in FIG. 1 so that the original document D is placed on the exposure glass 53 of the reader 55. The reader 55 optically reads an image on the original document D placed on the exposure glass 53.

Specifically, in the reader 55, a lamp emits light onto the original document D to scan the image on the original document D placed on the exposure glass 53. The light reflected by the original document D enters a color sensor via mirrors and lenses to form an image in the color sensor. The color sensor reads the image into image data corresponding to red, green, and blue colors, respectively, and converts the image data into electric image signals. An image processor performs a color conversion process, a color correction process, and a space frequency correction process according to the electric image signals to generate yellow, magenta, cyan, and black image data.

Thereafter, the reader 55 sends the yellow, magenta, cyan, and black image data to the writer 2. The writer 2 emits laser beams (e.g., exposure light beams) onto the photoconductive drums 21 of the process cartridges 20Y, 20M, 20C, and 20BK, respectively, according to the yellow, magenta, cyan, and black image data.

On the other hand, the four photoconductive drums 21 rotate clockwise in FIG. 1. In a charging process, the chargers 22 uniformly charge the surfaces of the photoconductive drums 21 at positions at which the chargers 22 oppose the photoconductive drums 21, respectively. Thus, an electric potential is formed on the photoconductive drums 21. Thereafter, the charged surfaces of the photoconductive drums 21 reach irradiation positions at which the laser beams irradiate the photoconductive drums 21, respectively.

In the writer 2, a light source emits laser beams corresponding to the yellow, magenta, cyan, and black image data. The laser beams entering the polygon mirror 3 are reflected by the polygon mirror 3, and pass through the lenses 4 and 5. After passing through the lenses 4 and 5, the laser beams move on different optical paths corresponding to the yellow, magenta, cyan, and black colors, respectively, in an exposure process.

The laser beam corresponding to the yellow color is reflected by the mirrors 6 to 8, and irradiates the surface of the photoconductive drum 21 of the process cartridge 20Y provided at a leftmost position in FIG. 1. Specifically, the polygon mirror 3 rotating at a high speed causes the laser beam corresponding to the yellow color to scan the photoconductive drum 21 in an axial direction of the photoconductive drum 21, that is, in a main scanning direction. Thus, an electrostatic latent image corresponding to the yellow color is formed on the photoconductive drum 21 charged by the charger 22.

Similarly, the laser beam corresponding to the magenta color is reflected by the mirrors 9 to 11, and irradiates the surface of the photoconductive drum 21 of the process cartridge 20M, that is, the second photoconductive drum 21 from the left in FIG. 1 to form an electrostatic latent image corresponding to the magenta color. The laser beam corresponding to the cyan color is reflected by the mirrors 12 to 14, and irradiates the surface of the photoconductive drum 21 of the process cartridge 20C, that is, the third photoconductive drum 21 from the left in FIG. 1 to form an electrostatic latent image corresponding to the cyan color. The laser beam corresponding to the black color is reflected by the mirror 15, and irradiates the surface of the photoconductive drum 21 of the process cartridge 20BK, that is, the fourth photoconductive drum 21 from the left in FIG. 1 to form an electrostatic latent image corresponding to the black color.

The electrostatic latent images formed on the surfaces of the photoconductive drums 21 reach development positions at which the development devices 23Y, 23M, 23C, and 23BK oppose the photoconductive drums 21, respectively. The development devices 23Y, 23M, 23C, and 23BK supply the yellow, magenta, cyan, and black toner to the photoconductive drums 21 to make the electrostatic latent images on the photoconductive drums 21 visible as yellow, magenta, cyan, and black toner images, respectively, in a development process.

After the development process, the yellow, magenta, cyan, and black toner images formed on the photoconductive drums 21 reach transfer positions at which the photoconductive drums 21 oppose the transfer-fixing belt 27 laid over and supported by a plurality of rollers 28A, 28B, and 28C, respectively. The transfer bias rollers 24 contact an inner circumferential surface of the transfer-fixing belt 27 at opposing positions at which the transfer bias rollers 24 oppose the photoconductive drums 21, respectively. The transfer bias rollers 24 transfer the yellow, magenta, cyan, and black toner images formed on the photoconductive drums 21 onto the transfer-fixing belt 27 sequentially in such a manner that the yellow, magenta, cyan, and black toner images are superimposed on a same position on the transfer-fixing belt 27 to form a color toner image in a first transfer process.

After the first transfer process, the surfaces of the photoconductive drums 21 reach cleaning positions at which the cleaners 25 oppose the photoconductive drums 21, respectively. The cleaners 25 remove residual toner not transferred and therefore remaining on the photoconductive drums 21 from the photoconductive drums 21, respectively, in a cleaning process.

Thereafter, the surfaces of the photoconductive drums 21 pass over dischargers, respectively, thus finishing a series of image forming processes performed on the photoconductive drums 21.

On the other hand, an outer circumferential surface of the transfer-fixing belt 27 serving as a transfer-fixing member on which the yellow, magenta, cyan, and black toner images are superimposed to form the color toner image rotates counterclockwise in a direction shown by an arrow in FIG. 1, and reaches a contact position (e.g., the nip N) at which the pressing roller 68 serving as a pressing member contacts the transfer-fixing belt 27. Unlike conventional transfer-fixing devices, the transfer-fixing device 66 according to this example embodiment may not include a heater (e.g., the heater 70) for heating the transfer-fixing belt 27 directly or may include a heater for heating the transfer-fixing belt 27 with a slight amount of heat.

Alternatively, the transfer-fixing device 66 may include the heater 70 provided upstream from the nip N in a rotation direction of the transfer-fixing belt 27 to heat the transfer-fixing belt 27 or the toner image carried by the transfer-fixing belt 27. However, the heater 70 heats the transfer-fixing belt 27 with an amount of heat smaller than an amount of heat of conventional heaters.

The color toner image carried by the transfer-fixing belt 27 is transferred and fixed onto a transfer-fixing side (e.g., a front side) of a recording medium P at the nip N formed between the transfer-fixing belt 27 and the pressing roller 68 in a transfer-fixing process. Specifically, the heating device 67 heats the transfer-fixing side of the recording medium P immediately before the nip N, and therefore heat on the transfer-fixing side of the recording medium P and heat on the transfer-fixing belt 27 preliminarily heated by the heater 70 heat and melt the color toner image on the recording medium P at the nip N. Alternatively, heat on the transfer-fixing side of the recording medium P heats and melts the color toner image on the recording medium P at the nip N. Simultaneously, pressure applied at the nip N fixes the color toner image on the transfer-fixing side of the recording medium P. Structure and operations of the transfer-fixing device 66 are explained in detail below by referring to FIGS. 2 and 3.

Thereafter, the outer circumferential surface of the transfer-fixing belt 27 reaches a cleaning position at which the belt cleaner 29 opposes the transfer-fixing belt 27. The belt cleaner 29 removes an adhered substance such as residual toner remaining on the transfer-fixing belt 27 from the transfer-fixing belt 27, finishing a series of transfer-fixing operations performed on the transfer-fixing belt 27.

Alternatively, a toner sensor and a cleaner may be provided at a position opposing the transfer-fixing belt 27, downstream from the most downstream photoconductive drum 21 for forming the yellow toner image, and upstream from the nip N in the rotation direction of the transfer-fixing belt 27. The cleaner may separatably contact the transfer-fixing belt 27. The toner sensor may detect a pattern image for image adjustment formed on the transfer-fixing belt 27 through the above-described image forming processes to perform density correction, color shift correction, and the like for each color based on a detection result provided by the toner sensor. In this case, the cleaner may remove the pattern image for image adjustment formed on the transfer-fixing belt 27 before the pattern image reaches the nip N.

A recording medium P is conveyed from the paper tray 61 to the nip N of the transfer-fixing device 66 through the conveyance guide 63, the registration roller pair 64, and the heating device 67.

Specifically, the feed roller 62 feeds the recording medium P contained in the paper tray 61 toward the registration roller pair 64 through the conveyance guide 63. The registration roller pair 64 feeds the recording medium P toward the nip N formed between the transfer-fixing belt 27 and the pressing roller 68 at a proper time at which the color toner image formed on the transfer-fixing belt 27 is transferred onto the recording medium P. As illustrated in FIG. 2, when the heat transmission plate 67*b* of the heating device 67 guides the recording medium P fed toward the nip N formed between the transfer-fixing belt 27 and the pressing roller 68 while the brush member 91 presses the recording medium P against the heat transmission plate 67*b*, the heat transmission plate 67*b* heats the transfer-fixing side of the recording medium P.

Thereafter, the recording medium P bearing the color toner image transferred and fixed thereto at the nip N is conveyed to the output roller pair 80 through an output conveyance path. The output roller pair 80 discharges the recording medium P to an outside of the image forming apparatus 1 as the recording medium P bearing the output image, thus finishing a series of image forming processes. In the image forming apparatus 1 according to this example embodiment, a conveyance speed or a process linear velocity of the recording medium P is set to about 300 mm/s.

A toner for use in the image forming apparatus 1 preferably has low-temperature fixability. Specifically, the toner preferably has a softening point (e.g., ½ flow temperature) of about 100 degrees centigrade.

Specific examples of binder resins for use in toner include polyester, styrene polymers and substituted styrene polymers such as polystyrene, poly-p-chlorostyrene, and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ether copolymers, styrene-vinyl ethyl ether copolymers, styrene-vinyl methyl ketone copolymers, styrene-butadiene copolymers, styrene-isoprene copolymers, styrene-acrylonitrile-indene copolymers, styrene-maleic acid copolymers, and styrene-maleic acid ester copolymers; and other resins such as polymethyl methacrylate, polybutylmethacrylate, polyvinyl chloride, polyvinyl acetate, polyethylene, polypropylene, polyurethane, polyamide, epoxy resins, polyvinyl butyral, polyacrylic resins, rosin, modified rosins, terpene resins, phenol resins, aliphatic or alicyclic hydrocarbon resins, aromatic petroleum resins, chlorinated paraffin, paraffin waxes, etc. Among these resins, resins including a polyester resin are preferably used for a toner to have sufficient fixability. Particularly, a crystalline polyester resin fully softens and melts when contacting paper to be firmly fixed thereon and produce images having high color reproducibility. The polyester resin is prepared by subjecting alcohol and carboxylic acid to condensation polymerization. Specific examples of the alcohol include diols such as polyethyleneglycol, diethyleneglycol, triethyleneglycol, 1,2-propylene glycol, 1,3-propylene glycol, 1,4-butanediol, neopentylglycol, and 1,4-butene diol; etherified bisphenols such as 1,4-bis(hydroxymethyl)cyclohexane, bisphenol A, hydrogenated bisphenol A, polyoxyethylated bisphenol A, and polyoxypropylated bisphenol A; bivalent alcohols which are the substituted of these alcohols with a saturated or unsaturated hydrocarbon group having 3 to 22 carbon atoms; and other bivalent alcohols.

Specific examples of the carboxylic acid used to prepare a polyester resin include maleic acids, fumaric acids, mesaconic acids, citraconic acids, itaconic acids, glutaconic acids, phthalic acids, isophthalic acids, terephthalic acids, cyclohexane dicarboxylic acids, succinic acids, adipic acids, sebacic acids, malonic acids, bivalent organic acids which are the substituted of these carboxylic acids with a saturated or unsaturated hydrocarbon group having 3 to 22 carbon atoms, their anhydrides, dimmers of lower alkyl esters and linoleic acids, and other bivalent organic acids.

In order to prepare a polyester resin as a binder resin, not only polymers formed of only these bifunctional monomers but also polymers formed of tri- or more polyfunctional monomers can be used. Specific examples of the tri- or more polyols as polyfunctional monomers include sorbitol, 1,2,3,6-hexanetetraol, 1,4-sorbitan, pentaerythritol, dipentaerythritol, tripentaerythritol, sucrose, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxymethylbenzene, etc.

Specific examples of tri- or more carboxylic acids include a 1,2,4-benzenetricarboxylic acid, a 1,2,5-benzenetricarboxylic acid, a 1,2,4-cyclohexane tricarboxylic acid, a 2,5,7-naphthalenetricarboxylic acid, a 1,2,4-naphthalenetricarboxylic acid, a 1,2,4-butanetricarboxylic acid, a 1,2,5-hexanetricarboxylic acid, 1,3-dicarboxyl-2-methyl-methylenecarboxypropane, tetra(methylenecarboxyl) methane, a 1,2,7,8-octantetracarboxylic acid, an empol trimer acid, and their anhydrides, etc.

The toner used in the image forming apparatus 1 may include a releasing agent to cause the toner to be easily released from the surface of the transfer-fixing belt 27 in the transfer-fixing process. The toner used in the image forming apparatus 1 may include known releasing agents, preferably, free fatty acid carnauba wax, montan wax, oxidized rice wax, ester wax, and/or a combination of two or more of the above waxes. Preferably, the carnauba wax may be microcrystalline and may have an acid number of 5 mgKOH/g or smaller and a particle size of about 1 μm or smaller when the carnauba wax is dispersed in a toner binder.

The montan wax may be generally refined from mineral. Like the carnauba wax, the montan wax may preferably be microcrystalline and have an acid number of from 5 mgKOH/g to 14 mgKOH/g. The oxidized rice wax may be obtained by oxidizing rice bran wax in the air and may preferably have an acid number of from 10 mgKOH/g to 30 mgKOH/g. When the waxes have an acid number smaller than the above-described ranges, the temperature of low temperature fixing may increase, providing improper low temperature fixing. When the waxes have an acid number greater than the above-described ranges, a cold offset temperature may increase, providing improper low temperature fixing. Wax in a range from about 1 to about 15 parts by weight, preferably from about 3 to about 10 parts by weight, may be preferably added to a binder resin of about 100 parts by weight. When an amount of wax is smaller than about 1 part by weight, the toner may provide a decreased releasing property, and thereby may not provide a desired effect. When an amount of wax is greater than about 15 parts by weight, toner particles may adhere to carriers.

An additive may be added to improve fluidity of the toner. The additive may include silica, titanium oxide, and/or alumina. Further, fatty acid metal salts and/or polyvinylidene fluoride may be added, as needed.

The transfer-fixing device 66 can heat the toner sufficiently. Accordingly, even when an additive such as silica having large particle size of submicron is used in a relatively great amount, fixing property and fixing temperature may not be affected. Thus, the additive can be added to the toner by considering fluidity and transfer property.

As illustrated in FIG. 2, the transfer-fixing device 66 includes the transfer-fixing belt 27 serving as a transfer-fixing member, the heating device 67 serving as a heater, the pressing roller 68 serving as a pressing member, and the brush member 91 serving as a biasing member.

The transfer-fixing belt 27 serving as a transfer-fixing member is an endless belt having a multilayer structure in which an elastic layer is provided on a base layer which serves as an inner circumferential surface of the transfer-fixing belt 27, and a releasing layer serving as a surface layer is provided on the elastic layer. The base layer includes polyimide resin having a layer thickness of about 80 μm. The elastic layer corresponds to or absorbs surface asperities of the recording medium P, and includes silicon rubber having a layer thickness of about 160 μm. The releasing layer provides releasing property for releasing toner and paper dust from the surface of the transfer-fixing belt 27, and includes fluorocarbon rubber or fluorocarbon resin having a layer thickness of about 7 μm. The transfer-fixing belt 27 has a width of about 300 mm in a width direction and a circumferential length of about 1,150 mm in the rotation direction.

The pressing roller 68 includes a cylindrical core metal including aluminum and a surface layer (e.g., a releasing layer) provided on the core metal. The pressing roller 68 rotates clockwise in FIG. 2. A pressing mechanism presses the pressing roller 68 against the roller 28A via the transfer-fixing belt 27. Thus, the desired nip N is formed between the pressing roller 68 and the transfer-fixing belt 27.

The surface layer of the pressing roller 68 includes PTFE (polytetrafluoroethylene), PFA (tetrafluoroethylene perfluoroalkylvinylether copolymer), FEP (tetrafluoroethylene hexafluoropropylene copolymer), and/or the like.

The heating device 67 is provided at a position near an entrance to the nip N of the transfer-fixing device 66. The heating device 67 includes the heating member 67*a*, the heat transmission plate 67*b*, and the electrode 67*c*. The heating member 67*a* is sandwiched between the heat transmission plate 67*b* and the electrode 67*c*. According to this example embodiment, the heating member 67*a* includes a resistance heat generating member of which resistance increases sharply when the temperature of the resistance heating generating member reaches a given Curie point. For example, the heating member 67*a* includes a positive character thermistor including a semiconductor ceramic element of barium titanate. According to this example embodiment, ten heating members 67*a* (e.g., ten positive character thermistors) are arranged in the width direction of the heating device 67 as illustrated in FIG. 3.

As illustrated in FIG. 2, the heat transmission plate 67*b* serving as a heat transmission member is a stainless steel plate having a plate thickness of about 0.2 mm. The heat transmission plate 67*b* extends from a position near the registration roller pair 64 to a position near the nip N, and serves as a guide (e.g., a guide plate) for guiding the recording medium P conveyed toward the nip N. Further, the heat transmission plate 67*b* contacts the transfer-fixing side (e.g., the front side) of the recording medium P conveyed toward the nip N to transmit heat generated by the heating member 67*a* to the transfer-fixing side of the recording medium P. The alternator 71 is connected to the heat transmission plate 67*b* so that the heat transmission plate 67*b* serves as another electrode.

The alternator 71 is connected to the electrode 67*c* and the heat transmission plate 67*b* sandwiching the heating member 67*a*. When the switch 72 is turned on, a voltage of AC 100 volt is applied to both ends of the heating member 67*a* in a direction perpendicular to a recording medium conveyance direction. Accordingly, an electric current flows inside the heating member 67*a* to cause the heating member 67*a* to generate heat. The heat generated by the heating member 67*a* is transmitted to the transfer-fixing side of the recording medium P through the heat transmission plate 67*b*.

According to this example embodiment, the heat transmission plate 67*b* may include copper which provides a high thermal conductivity and a low thermal capacity per volume at a relatively low cost. Thus, the heating device 67 provides high heating efficiency at a relatively low cost.

The heating member 67*a* may have a Curie point lower than an ignition point of the recording medium P. Accordingly, the heating member 67*a* provides self temperature control function for preventing the temperature of the recording medium P from increasing to a level equaling to or higher than the ignition point of the recording medium P.

For example, according to this example embodiment, the heating member 67*a* has a Curie point of 200 degrees centigrade. Accordingly, when the temperature of the heating member 67*a* exceeds 200 degrees centigrade, resistance between the electrode 67*c* and the heat transmission plate 67*b* increases sharply to reduce the electric current flowing inside the heating member 67*a*. Specifically, when the temperature of the heating member 67*a* is 210 degrees centigrade, the electric current flowing inside the heating member 67*a* is reduced to a half. When the temperature of the heating member 67*a* is 220 degrees centigrade, the electric current flowing inside the heating member 67*a* is reduced to a quarter.

The temperature of the heating member 67*a* having the above-described configuration increases to a range from 190 degrees centigrade to 200 degrees centigrade when 6 seconds elapse after power of 1,200 W is applied. Thereafter, the self temperature control function of the heating member 67*a* prevents the temperature of the heating member 67*a* from increasing to the temperature not lower than 210 degrees centigrade. In order to control the temperature of the heating member 67*a* at or below 210 degrees centigrade, the temperature of the heating member 67*a* is controlled to a desired temperature by PID (proportional-integral-derivative) control using a temperature sensor. Even when a control circuit is out of order, the temperature of the heating member 67*a* does not increase to the temperature not lower than 210 degrees centigrade, providing safety. Further, according to this example embodiment, the plurality of heating members 67*a* is arranged in the width direction of the heating device 67. Thus, each of the plurality of heating members 67*a* performs the self temperature control function to suppress temperature unevenness within 10 degrees centigrade in the width direction of the heating device 67.

The heating device 67 having the above-described structure heats the transfer-fixing side (e.g., the front side) of the recording medium P immediately before the transfer-fixing process. In other words, the heating device 67 heats the transfer-fixing side of the recording medium P in such a manner that the recording medium P is conveyed to the nip N before the temperature of a back side, that is, a side opposite to the transfer-fixing side, of the recording medium P increases or before heat is transmitted from the front side to the back side of the recording medium P.

The following describes an experiment performed in the transfer-fixing device 66.

Temperature unevenness on the transfer-fixing side of the recording medium P was simulated when the recording medium P, that is, thick paper having a weight of 300 g, contacted a copper plate having the thickness of 1 mm and heated to 160 degrees centigrade for 60 msec, and then the recording medium P was conveyed in air having an ambient temperature of 40 degrees centigrade. The simulation revealed that the temperature of the recording medium P heated up to about 140 degrees centigrade by the copper plate was decreased to 110 degrees centigrade when the recording medium P was conveyed only for 10 msec in air having an ambient temperature of 40 degrees centigrade. This is equivalent to a conveyance distance of 3 mm when the recording medium P is conveyed at a conveyance speed of 300 mm/s. Therefore, in order to increase heating efficiency for heating the recording medium P before the transfer-fixing process, a heat transmission plate or a heat transmission member for heating the recording medium P needs to be provided as close to the nip N as possible.

According to this example embodiment, a leading edge of the plate-shaped heat transmission plate 67*b* is provided as close to the nip N as possible and the heat transmission plate 67*b* has a length in the recording medium conveyance direction which is as long as possible, so as to increase heating efficiency for heating the recording medium P before the transfer-fixing process.

Another experiment was performed to measure the temperature unevenness of the transfer-fixing side of the recording medium P, that is, copier paper type 6200 available from Ricoh Company, Ltd., after the recording medium P passed under the heat transmission plate 67*b* heated in a range from 140 degrees centigrade to 200 degrees centigrade when the brush member 91 was not provided. The experiment revealed that when the recording medium P was conveyed for a range from 0 msec to 60 msec after the recording medium P passed under the heat transmission plate 67*b*, the temperature of the transfer-fixing side of the recording medium P was decreased within 15 degrees centigrade.

According to this example embodiment, the heat transmission plate 67*b* includes the guide surface portion 67*bs* which contacts and guides the recording medium P and is nickel-plated with fluorocarbon resin particles. For example, PTFE (polytetrafluoroethylene) of 30 volume percent is dispersed in a nickel-plated film. Such coating provides a precipitation hardness of about Hv 300 which is harder than a hardness provided by general resin coating, thus providing improved slipping, wear-resistance, and releasing properties. Accordingly, less toner and paper dust may be adhered to the heat transmission plate 67*b*, and durability of the heat transmission plate 67*b* may be improved.

Alternatively, the guide surface portion 67*bs* of the heat transmission plate 67*b* which contacts the recording medium P may be coated with diamond-like carbon (DLC) and/or graphite-like carbon (GLC) providing a high wear resistance.

The heating device 67 heats the transfer-fixing side of the recording medium P so that the temperature of the transfer-fixing side of the recording medium P is greater than the surface temperature of the transfer-fixing belt 27. In other words, the toner image T on the transfer-fixing belt 27 receives heat from the recording medium P at the nip N and is heated and melted by the heat.

The heating device 67 heats the transfer-fixing side of the recording medium P, and sets the temperature sufficient to apply gloss to the toner image T independently. Accordingly, the temperature (e.g., the fixing temperature) of the transfer-fixing belt 27, which may be heated by the heater 70 depicted in FIG. 1 (e.g., a halogen heater or a carbon heater) if the heater 70 is installed optionally, is set to a lower temperature. Further, the recording medium P is heated immediately before the transfer-fixing process. Accordingly, the recording medium P is not heated excessively, and the toner image T is not adhered to the recording medium P excessively.

In other words, the transfer-fixing device 66 provides low temperature fixing and a shortened warm-up time, saving energy. Further, heat transmission to the transfer-fixing belt 27 is suppressed to improve durability of the transfer-fixing belt 27. The transfer-fixing belt 27 is heated to a lower temperature to suppress thermal degradation of the transfer-fixing belt 27.

In the transfer-fixing device 66, the brush member 91 serving as a biasing member presses or biases the recording medium P guided by the heat transmission plate 67*b* to the nip N against the heat transmission plate 67*b*. Accordingly, the recording medium P is adhered to the heat transmission plate 67*b* with an improved adhesive force for a proper time. Consequently, the heat transmission plate 67*b* increases the surface temperature of the recording medium P to a target temperature precisely to suppress faulty fixing.

The brush member 91 includes heat-resistant polyimide fiber having a diameter of 0.2 mm. The bristles 91*a* are arranged in the brush member 91 at a density of about 50 pieces per square centimeter so that the bristles 91*a* point-contact or line-contact the recording medium P guided by the heat transmission plate 67*b* at a plurality of positions. The brush member 91 contacts the recording medium P at an area as small as possible to press the recording medium P against the heat transmission plate 67*b*, so as to suppress decrease of heating efficiency for heating the recording medium P due to transmission of heat from the recording medium P to the brush member 91. Also, the brush member 91 suppresses decrease of conveyance efficiency for conveying the recording medium P.

The bristles 91*a* of the brush member 91 may be straight or looped. The bristles 91*a* may have thick points or a hollow shape. For example, with the hollow bristles 91*a* having an outer diameter of about 0.24 mm, a fan is provided below the brush member 91 to direct air to the recording medium P guided by the heat transmission plate 67*b* through hollow portions of the hollow bristles 91*a* so that the air presses the recording medium P against the heat transmission plate 67*b* to prevent the bristles 91*a* from bending.

The bristles 91*a* of the brush member 91 may include a magnetic material (e.g., SUS 304). Accordingly, a magnetic force of a magnet provided on the heat transmission plate 67*b* attracts the bristles 91*a* to prevent the bristles 91*a* from bending, so as to suppress faulty heating of the recording medium P due to a weakened biasing force of the brush member 91 for pressing the recording medium P against the heat transmission plate 67*b* when the bristles 91*a* are bent by repeated contacts to the recording medium P.

The transfer-fixing device 66 minimizes heating of the transfer-fixing belt 27 to supplement heat needed to heat and melt the toner image T by heating the recording medium P effectively immediately before the recording medium P reaches the nip N. However, the transfer-fixing belt 27 may receive a great amount of heat having an uneven heat distribution from the heated recording medium P. As a result, temperature unevenness may generate in the width direction of the transfer-fixing belt 27 perpendicular to the recording medium conveyance direction, resulting in formation of a faulty fixed toner image T providing uneven fixing and offset.

To address this problem, as illustrated in FIG. 2, the equalization roller 85 equalizes the temperature distribution of the surface of the transfer-fixing belt 27 in the width direction of the transfer-fixing belt 27 after the surface of the transfer-fixing belt 27 passes through the nip N. The equalization roller 85 may also serve as a cooling member for cooling the transfer-fixing belt 27 after the transfer-fixing process.

The equalization roller 85 is a roller provided downstream from the nip N in a moving direction of the transfer-fixing belt 27 in such a manner that the transfer-fixing belt 27 is stretched over and supported by the equalization roller 85 and the three rollers 28A to 28C depicted in FIG. 1. The equalization roller 85 is a heat pipe inside which heat is convected efficiently to equalize the temperature distribution of the surface of the transfer-fixing belt 27 in the width direction of the transfer-fixing belt 27. Simultaneously, the equalization roller 85 serving as a cooling member may cool the transfer-fixing belt 27. Accordingly, even when the heating device 67 heats the recording medium P immediately before the recording medium P enters the nip N by minimizing heating of the transfer-fixing belt 27, faulty fixing such as uneven fixing and offset may be suppressed.

Figure 4:
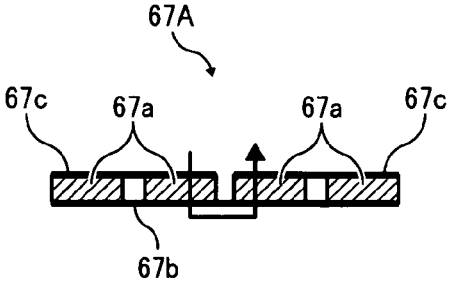
FIG. 4 is a partially sectional view (according to an example embodiment) of a variation of the heating device shown in FIG. 3 in a width direction of the heating device.

The structure of the heating device 67 is not limited to the structure shown in FIG. 2. For example, FIG. 4 illustrates a heating device 67A as a variation of the heating device 67. FIG. 4 is a partially sectional view of the heating device 67A in a width direction of the heating device 67A. In the heating device 67A, a plurality of heating members 67*a* is sandwiched between the electrode 67*c* divided into two pieces and the heat transmission plate 67*b*. The alternator 71 depicted in FIG. 2 is connected to each of the two electrodes 67*c* to apply an alternating voltage between the two electrodes 67*c*. Accordingly, an electric current flows from one electrode 67*c* to another electrode 67*c* through one heating member 67*a*, the heat transmission plate 67*b*, and another heating member 67*a* as shown by an arrow in FIG. 4. Thus, the heating members 67*a* are heated. With this structure, a small voltage is applied to the heating member 67*a*, resulting in a small thermal capacity of the heating member 67*a*. Consequently, PTC (positive temperature coefficient) character is utilized to improve, control response of the heating device 67A.

Figure 5:
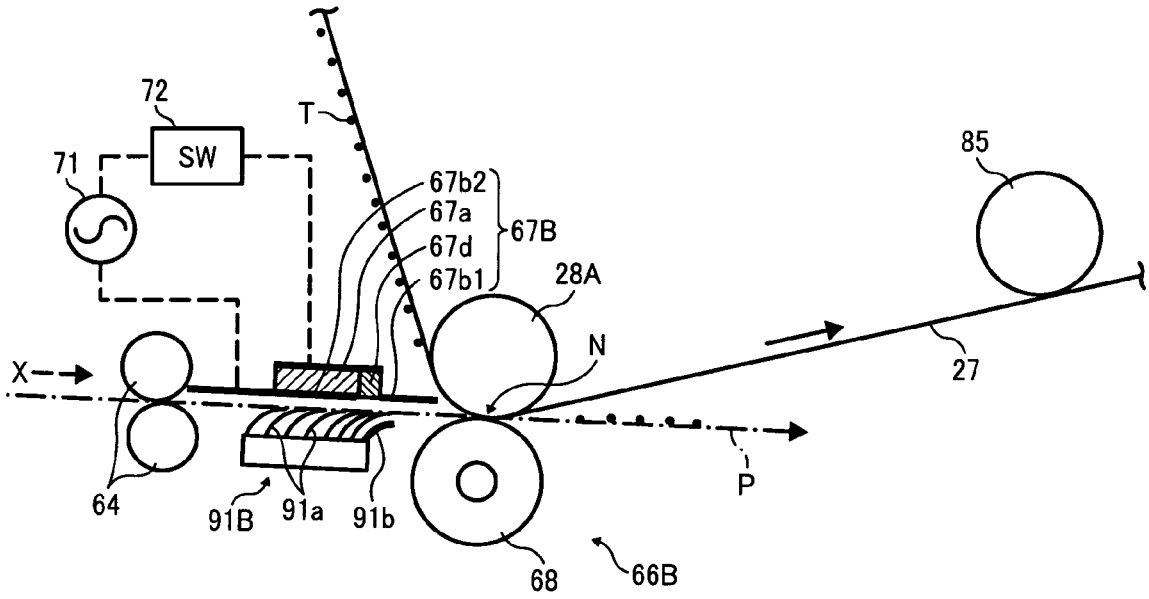
FIG. 5 is a sectional view (according to an example embodiment) of a transfer-fixing device including another variation of the heating device shown in FIG. 3.

FIG. 5 is a sectional view of a transfer-fixing device 66B including a heating device 67B as another variation of the heating device 67 depicted in FIG. 2. As illustrated in FIG. 5, the transfer-fixing device 66B includes the heating device 67B and a brush member 91B. The heating device 67B includes the heating member 67*a*, a first heat transmission plate 67*b*1, a second heat transmission plate 67*b*2, and an insulator 67*d*. The brush member 91B includes the bristles 91*a* and a plate member 91*b*. The heating device 67B replaces the heating device 67 depicted in FIG. 2. The brush member 91B replaces the brush member 91 depicted in FIG. 2. The other elements of the transfer-fixing device 66B are equivalent to the elements of the transfer-fixing device 66 depicted in FIG. 2.

A heat transmission plate of the heating device 67B is divided into two pieces, that is, the first heat transmission plate 67*b*1 and the second heat transmission plate 67*b*2. The first heat transmission plate 67*b*1 is wound from an upper surface of the heating member 67*a* along a side surface of the heating member 67*a* to a lower surface of the heating member 67*a*, and is wound at the lower surface of the heating member 67*a* to extend from the lower surface of the heating member 67*a* to a position near the nip N to guide the recording medium P. The second heat transmission plate 67*b*2 extends from the lower surface of the heating member 67*a* to a position near the registration roller pair 64. The insulator 67*d* is provided between the first heat transmission plate 67*b*1 and the second heat transmission plate 67*b*2. The alternator 71 is connected to the first heat transmission plate 67*b*1 and the second heat transmission plate 67*b*2. With this structure, the heating device 67B provides effects equivalent to the effects provided by the heating device 67 depicted in FIG. 2.

The brush member 91B includes the plate member 91*b* serving as a regulating member for preventing the bristles 91*a* from being caught in the nip N. The plate member 91*b* is provided at an edge of the brush member 91B facing the pressing roller 68. For example, the plate member 91*b* is a stainless steel plate having a plate thickness of 0.3 mm, and is curved in accordance with a curvature of the pressing roller 68. A gap of about 1 mm may be provided between the plate member 91*b* and the pressing roller 68. This structure of the brush member 91B prevents the bristles 91*a* from bending and being caught by the pressing roller 68.

Figure 6:
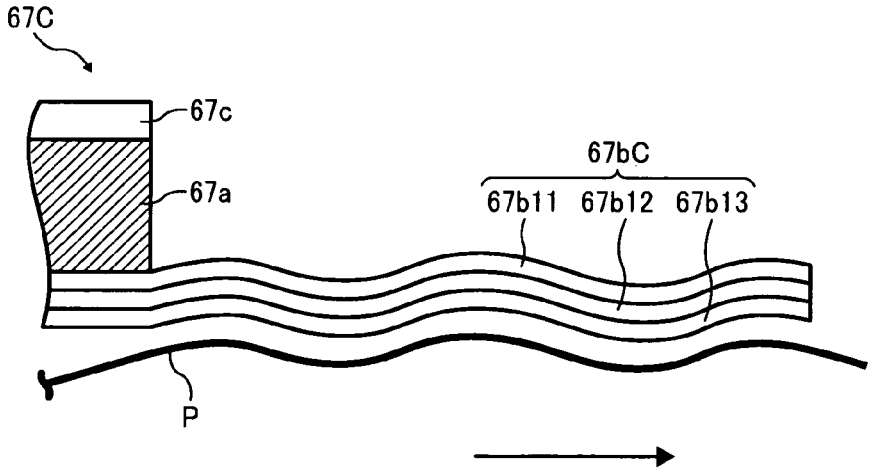
FIG. 6 is a sectional view (according to an example embodiment) of yet another variation of the heating device shown in FIG. 3.

In the transfer-fixing device 66 depicted in FIG. 2, the heat transmission plate 67*b* includes copper. Alternatively, the heat transmission plate 67*b* may include a plurality of foils as illustrated in FIG. 6. FIG. 6 is a sectional view of a heating device 67C including such foils. As illustrated in FIG. 6, the heating device 67C includes a heat transmission plate 67*b*C. The heat transmission plate 67*b*C includes foils 67*b*11, 67*b*12, and 67*b*13. The heat transmission plate 67*b*C replaces the heat transmission plate 67*b* depicted in FIG. 2. The other elements of the heating device 67C are equivalent to the elements of the heating device 67 depicted in FIG. 2.

A plurality of foils 67*b*11, 67*b*12, and 67*b*13 includes a high thermal conductivity material, and is layered to form the heat transmission plate 67*b*C. The plurality of foils 67*b*11, 67*b*12, and 67*b*13 may include a material electrostatically attracting the recording medium P.

With this structure of the heat transmission plate 67*b*C, even when the recording medium P has surface asperities as illustrated in FIG. 6, the heat transmission plate 67*b*C corresponds to or absorbs the surface asperities of the recording medium P, and therefore the recording medium P is adhered to the heat transmission plate 67*b*C, improving heating efficiency for heating the recording medium P and reducing temperature unevenness of the recording medium P.

As described above, with the heating device 67, 67A, 67B, or 67C depicted in FIG. 2, 4, 5, or 6, respectively, and the brush member 91 or 91B depicted in FIG. 2 or 5, respectively, the heat transmission member (e.g., the heat transmission plate 67*b*, 67*b*1 and 67*b*2, or 67*b*C) heats the transfer-fixing side of the recording medium P while the heat transmission member guides the recording medium P to the nip N formed between the transfer-fixing member (e.g., the transfer-fixing belt 27) and the pressing member (e.g., the pressing roller 68). The biasing member (e.g., the brush member 91 or 91B) presses or biases the recording medium P guided by the heat transmission member against the heat transmission member, thus reducing energy consumption, suppressing formation of a faulty fixed toner image or a toner image having uneven gloss, and providing proper fixing property.

The heating member (e.g., the heating member 67*a*) includes the resistance heat generating member (e.g., the positive character thermistor) to heat the heat transmission member. Alternatively, the heat transmission member may include a metal material of which magnetic permeability decreases at a given Curie point so that the heat transmission member is heated by induction heating to provide effects equivalent to the effects provided by the heat transmission member depicted in FIGS. 2 to 6.

For example, a heating device may include a heat transmission plate and an induction coil. The heat transmission plate includes a magnetic shunt alloy such as nickel and/or iron and has a plate thickness of about 0.3 mm. The induction coil serves as a heating member opposing the heat transmission plate. When a high-frequency voltage of 20 kHz is applied to the induction coil, the heat transmission plate is heated by induction heating, and transmits heat to the transfer-fixing side of the recording medium P. In the heat transmission plate, a nickel component occupies about 40 percent in the magnetic shunt alloy. When the temperature of the heat transmission plate reaches a Curie point of 200 degrees centigrade, the magnetic permeability decreases sharply and the heat transmission plate is not heated by induction heating. For example, the temperature of the heat transmission plate increases to a range from 190 degrees centigrade to 200 degrees centigrade for 3 seconds after power of 1,200 W is applied. Thereafter, self temperature control function of the heat transmission plate prevents the temperature of the heat transmission plate from increasing to 210 degrees centigrade or higher.

The brush member serves as a biasing member for pressing the recording medium P against the heat transmission plate. Alternatively, a spring may be used as a biasing member. In this case, a slide surface of the spring over which the recording medium P slides may be coated with a low friction material such as fluorocarbon resin to reduce friction between the spring and the recording medium P.

Figure 7:
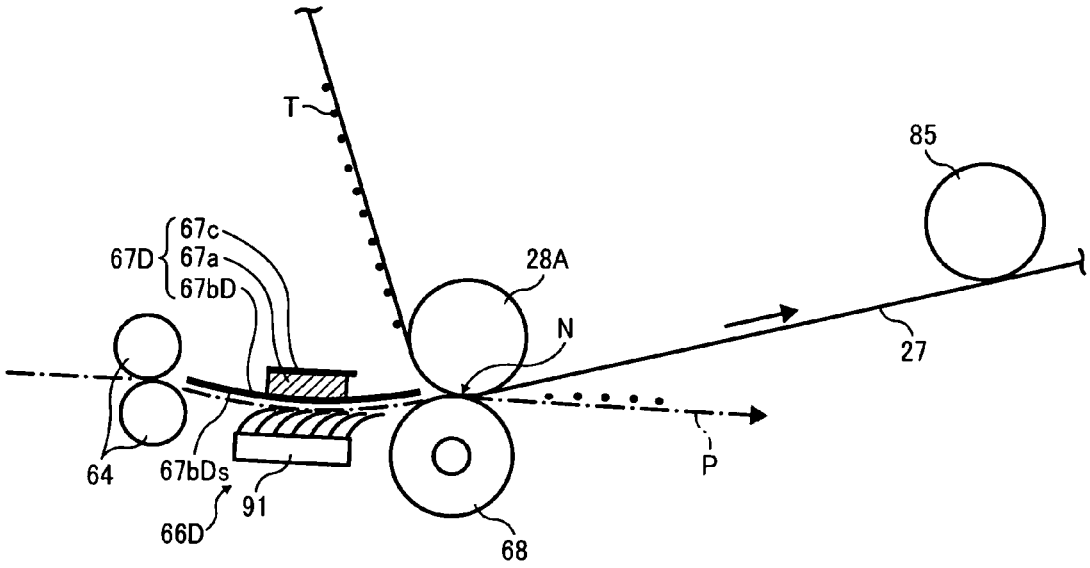
FIG. 7 is a sectional view of a transfer-fixing device according to another example embodiment.

FIG. 7 is a sectional view of a transfer-fixing device 66D. As illustrated in FIG. 7, the transfer-fixing device 66D includes a heating device 67D. The heating device 67D includes the heating member 67*a*, a heat transmission plate 67*b*D, and the electrode 67*c*. The heat transmission plate 67*b*D includes a guide surface portion 67*b*Ds. The heating device 67D replaces the heating device 67 depicted in FIG. 2. The other elements of the transfer-fixing device 66D are equivalent to the elements of the transfer-fixing device 66 depicted in FIG. 2.

Unlike in the transfer-fixing device 66, in the transfer-fixing device 66D, the heat transmission plate 67*b*D has a convex shape to face the recording medium P to guide the recording medium P. The recording medium P is conveyed at different speeds at positions upstream and downstream from the heat transmission plate 67*b*D in the recording medium conveyance direction, respectively.

Like in the embodiment illustrated in FIGS. 2 to 6, in the heating device 67D for heating the recording medium P immediately before the transfer-fixing process, the heat transmission plate 67*b*D extends from the position near the registration roller pair 64 to the position near the nip N to guide the recording medium P to the nip N. The brush member 91 serves as a biasing member opposing the heat transmission plate 67*b*D.

The heat transmission plate 67*b*D includes the guide surface portion 67*b*Ds serving as a curved surface portion having a convex shape to face the recording medium P guided by the heat transmission plate 67*b*D as illustrated in FIG. 7. For example, the heat transmission plate 67*b*D is curved at a curvature of about 300 R.

A conveyance speed for conveying the recording medium P at a position upstream from the guide surface portion 67*b*Ds is smaller than a conveyance speed for conveying the recording medium P at a position downstream from the guide surface portion 67*b*Ds in the recording medium conveyance direction. For example, a linear velocity of the recording medium P at an outer circumferential surface of the registration roller pair 64 is decreased by about one percent compared to a linear velocity of the recording medium P opposing the roller 28A at the nip N. In other words, a circumferential velocity of the registration roller pair 64 is decreased by about one percent compared to a circumferential velocity of the roller 28A.

With this structure of the transfer-fixing device 66D, the recording medium P is pulled toward the nip N so that the recording medium P is conveyed along the heat transmission plate 67*b*D having the convex shape. Accordingly, the recording medium P is adhered to the heat transmission plate 67*b*D precisely to improve heating efficiency for heating the recording medium P. For example, according to a measurement using thermography, the surface temperature of the recording medium P heated by the heat transmission plate 67*b*D was increased by a range from 5 degrees centigrade to 10 degrees centigrade compared to when the recording medium P was heated by the heat transmission plate 67*b* depicted in FIG. 2.

When the pressing roller 68 has a hand drum shape, the heat transmission plate 67*b*D may correspond to the shape. For example, when an outer diameter of a center of the pressing roller 68 is smaller by 0.1 mm than an outer diameter of both ends of the pressing roller 68 in a width direction, that is, in an axial direction, of the pressing roller 68, a center of the heat transmission plate 67*b*D in a width direction of the heat transmission plate 67*b*D corresponding to the axial direction of the pressing roller 68 may have a curvature of 250 R. By contrast, both ends of the heat transmission plate 67*b*D in the width direction of the heat transmission plate 67*b*D may have a curvature of 300 R.

As described above, like in the embodiment illustrated in FIGS. 2 to 6, with the heating device 67D and the brush member 91, the heat transmission member (e.g., the heat transmission plate 67*b*D) heats the transfer-fixing side of the recording medium P while the heat transmission member guides the recording medium P to the nip N formed between the transfer-fixing member (e.g., the transfer-fixing belt 27) and the pressing member (e.g., the pressing roller 68). The biasing member (e.g., the brush member 91) presses or biases the recording medium P guided by the heat transmission member against the heat transmission member, thus reducing energy consumption, suppressing formation of a faulty fixed toner image or a toner image having uneven gloss, and providing proper fixing property.

Figure 8:
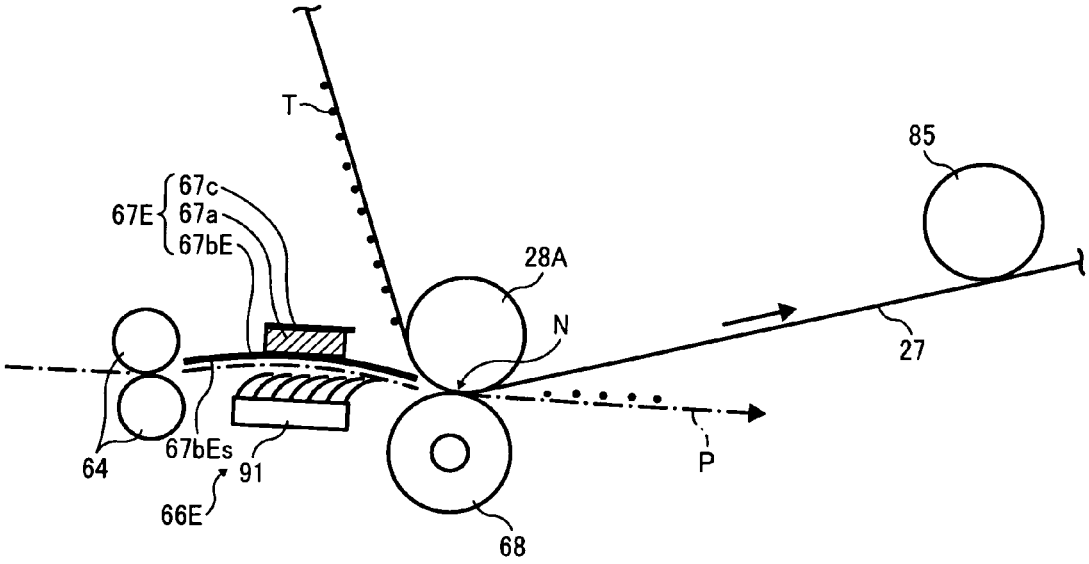
FIG. 8 is a sectional view of a transfer-fixing device according to yet another example embodiment.

FIG. 8 is a sectional view of a transfer-fixing device 66E. As illustrated in FIG. 8, the transfer-fixing device 66E includes a heating device 67E. The heating device 67E includes the heating member 67*a*, a heat transmission plate 67*b*E, and the electrode 67*c*. The heat transmission plate 67*b*E includes a guide surface portion 67*b*Es. The heating device 67E replaces the heating device 67 depicted in FIG. 2. The other elements of the transfer-fixing device 66E are equivalent to the elements of the transfer-fixing device 66 depicted in FIG. 2.

Unlike in the transfer-fixing device 66, in the transfer-fixing device 66E, the heat transmission plate 67*b*E has a concave shape to face the recording medium P to guide the recording medium P. The recording medium P is conveyed at different speeds at positions upstream and downstream from the heat transmission plate 67*b*E in the recording medium conveyance direction, respectively.

Like in the embodiment illustrated in FIGS. 2 to 6, in the heating device 67E for heating the recording medium P immediately before the transfer-fixing process, the heat transmission plate 67*b*E extends from the position near the registration roller pair 64 to the position near the nip N to guide the recording medium P to the nip N. The brush member 91 serves as a biasing member opposing the heat transmission plate 67*b*E.

The heat transmission plate 67*b*E includes the guide surface portion 67*b*Es serving as a curved surface portion having a concave shape to face the recording medium P guided by the heat transmission plate 67*b*E as illustrated in FIG. 8. For example, the heat transmission plate 67*b*E is curved at a curvature of about 300 R in a direction opposite to a direction in which the heat transmission plate 67*b*D is curved as illustrated in FIG. 7.

A conveyance speed for conveying the recording medium P at a position upstream from the guide surface portion 67*b*Es is greater than a conveyance speed for conveying the recording medium P at a position downstream from the guide surface portion 67*b*Es in the recording medium conveyance direction. For example, a linear velocity of the recording medium P at the outer circumferential surface of the registration roller pair 64 is increased by about one percent compared to a linear velocity of the recording medium P opposing the roller 28A at the nip N. In other words, a circumferential velocity of the registration roller pair 64 is increased by about one percent compared to a circumferential velocity of the roller 28A.

With this structure of the transfer-fixing device 66E, the recording medium P is pushed by the nip N so that the recording medium P is conveyed along the heat transmission plate 67*b*E having the concave shape. Accordingly, the recording medium P is adhered to the heat transmission plate 67*b*E precisely to improve heating efficiency for heating the recording medium P. For example, according to a measurement using thermography, the surface temperature of the recording medium P heated by the heat transmission plate 67*b*E was increased by a range from 5 degrees centigrade to 10 degrees centigrade compared to when the recording medium P was heated by the heat transmission plate 67*b* depicted in FIG. 2.

As described above, like in the embodiments illustrated in FIGS. 2 to 7, with the heating device 67E and the brush member 91, the heat transmission member (e.g., the heat transmission plate 67*b*E) heats the transfer-fixing side of the recording medium P while the heat transmission member guides the recording medium P to the nip N formed between the transfer-fixing member (e.g., the transfer-fixing belt 27) and the pressing member (e.g., the pressing roller 68). The biasing member (e.g., the brush member 91) presses or biases the recording medium P guided by the heat transmission member against the heat transmission member, thus reducing energy consumption, suppressing formation of a faulty fixed toner image or a toner image having uneven gloss, and providing proper fixing property.

Figure 9A:
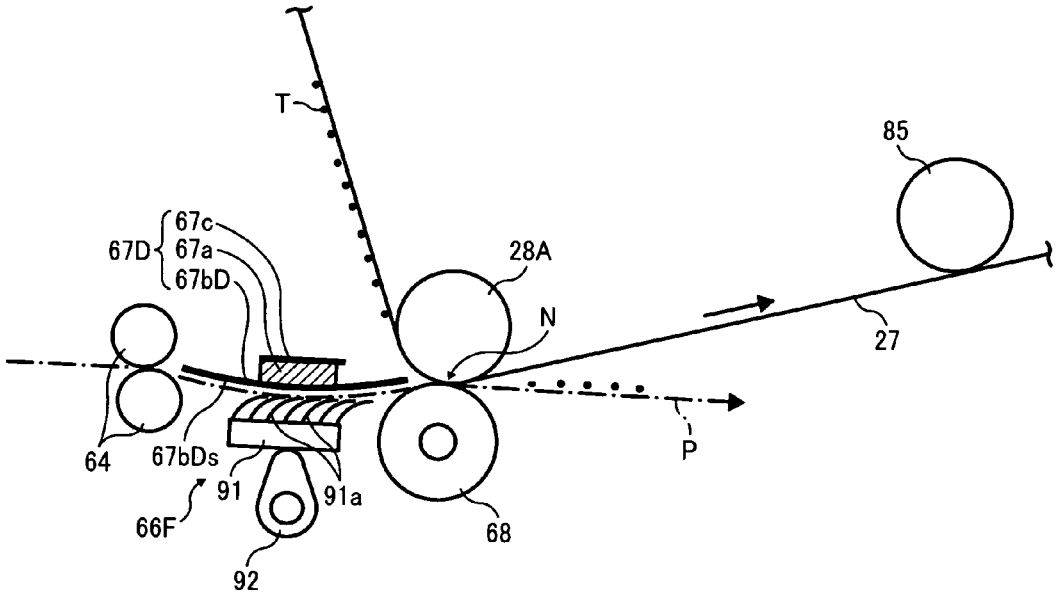
FIG. 9A is a sectional view of a transfer-fixing device according to yet another example embodiment when a biasing member included in the transfer-fixing device contacts a recording medium.
Figure 9B:
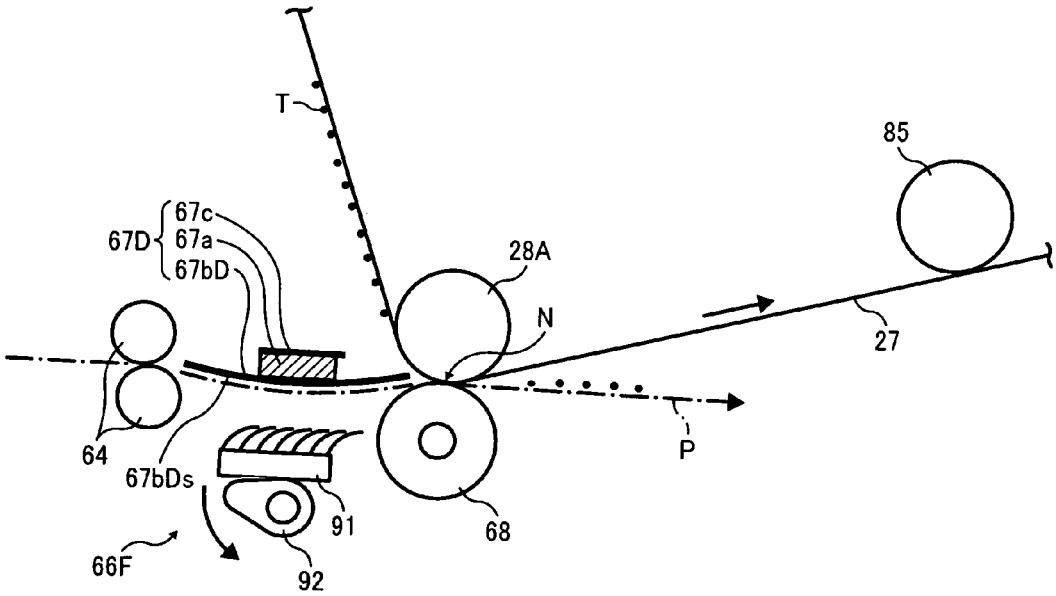
FIG. 9B is a sectional view (according to an example embodiment) of the transfer-fixing device shown in FIG. 9A when the biasing member is separated from the recording medium.

FIGS. 9A and 9B illustrate a sectional view of a transfer-fixing device 66F. As illustrated in FIGS. 9A and 9B, the transfer-fixing device 66F includes a cam 92. The other elements of the transfer-fixing device 66F are equivalent to the elements of the transfer-fixing device 66D depicted in FIG. 7.

Unlike in the transfer-fixing device 66D, in the transfer-fixing device 66F, the brush member 91 moves to contact and separate from the recording medium P.

Like in the embodiments illustrated in FIGS. 2 to 8, in the heating device 67D for heating the recording medium P immediately before the transfer-fixing process, the heat transmission plate 67*b*D extends from the position near the registration roller pair 64 to the position near the nip N to guide the recording medium P to the nip N. The brush member 91 serves as a biasing member opposing the heat transmission plate 67*b*D.

As illustrated in the heating device 67D depicted in FIG. 7, the heating device 67D includes the heat transmission plate 67*b*D having the convex shape.

A linear velocity of the recording medium P at the outer circumferential surface of the registration roller pair 64 is decreased by about one percent compared to a linear velocity of the recording medium P opposing the roller 28A at the nip N. In other words, a circumferential velocity of the registration roller pair 64 is decreased by about one percent compared to a circumferential velocity of the roller 28A.

In the transfer-fixing device 66F, the brush member 91 serving as a biasing member is controlled to press a leading edge and a trailing edge of the recording medium P in the recording medium conveyance direction against the heat transmission plate 67*b*D for guiding the recording medium P.

For example, as illustrated in FIGS. 9A and 9B, rotation of the cam 92 lifts and lowers the brush member 91. When the leading edge of the recording medium P conveyed in the recording medium conveyance direction reaches an opposing position at which the leading edge of the recording medium P opposes the brush member 91, the cam 92 lifts the brush member 91 to cause the brush member 91 to press the leading edge of the recording medium P against the heat transmission plate 67*b*D actively with a substantial force as illustrated in FIG. 9A. Thereafter, when a center portion of the recording medium P in the recording medium conveyance direction reaches the opposing position at which the center portion of the recording medium P opposes the brush member 91, the cam 92 lowers the brush member 91 to cause the brush member 91 to interrupt pressing the center portion of the recording medium P against the heat transmission plate 67*b*D actively with the substantial force as illustrated in FIG. 9B. Finally, when the trailing edge of the recording medium P conveyed in the recording medium conveyance direction reaches the opposing position at which the trailing edge of the recording medium P opposes the brush member 91, the cam 92 lifts the brush member 91 again to cause the brush member 91 to press the trailing edge of the recording medium P against the heat transmission plate 67*b*D actively with the substantial force as illustrated in FIG. 9A.

The above-described structure and control of the transfer-fixing device 66F reduce an amount of paper dust generated by the bristles 91*a* scrubbing the back side of the recording medium P. Further, the transfer-fixing device 66F prevents the bristles 91*a* from scrubbing and damaging a fixed toner image on a first side, that is, the back side, of the recording medium P for duplex printing. For example, when the amount of paper dust was measured by passing 1,000 sheets of recording media P through the transfer-fixing device 66F, the amount of paper dust generated when the cam 92 lifted and lowered the brush member 91 with the structure and operations illustrated in FIGS. 9A and 9B was reduced substantially compared to when the brush member 91 was not moved with the structure and operations illustrated in FIG. 7. When the brush member 91 contacted the recording medium P with a pressing force reduced by one-half instead of separating the brush member 91 from the recording medium P completely, the amount of paper dust was reduced substantially like in the transfer-fixing device 66F illustrated in FIG. 9A.

As described above, like in the embodiments illustrated in FIGS. 2 to 8, in the transfer-fixing device 66F, the heat transmission member (e.g., the heat transmission plate 67*b*D) heats the transfer-fixing side of the recording medium P while the heat transmission member guides the recording medium P to the nip N formed between the transfer-fixing member (e.g., the transfer-fixing belt 27) and the pressing member (e.g., the pressing roller 68). The biasing member (e.g., the brush member 91) presses or biases the recording medium P guided by the heat transmission member against the heat transmission member, thus reducing energy consumption, suppressing formation of a faulty fixed toner image or a toner image having uneven gloss, and providing proper fixing property.

Figure 10:
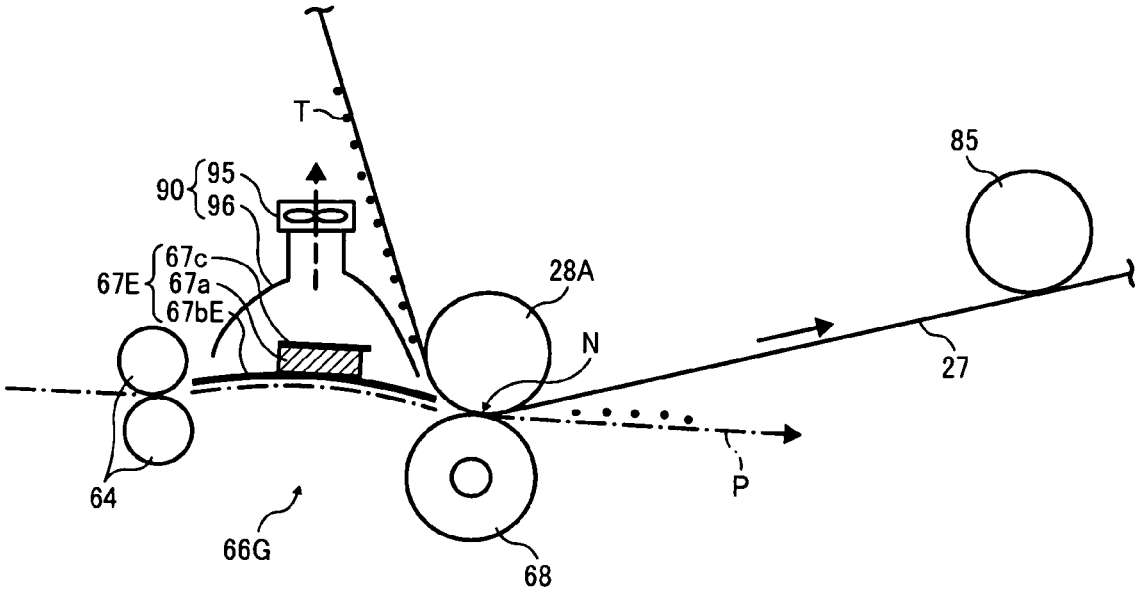
FIG. 10 is a sectional view of a transfer-fixing device according to yet another example embodiment.

FIG. 10 is a sectional view of a transfer-fixing device 66G. As illustrated in FIG. 10, the transfer-fixing device 66G includes a vacuum mechanism 90. The vacuum mechanism 90 includes a vacuum fan 95 and a duct 96. The vacuum mechanism 90 replaces the brush member 91 depicted in FIG. 8. The other elements of the transfer-fixing device 66G are equivalent to the elements of the transfer-fixing device 66E depicted in FIG. 8.

Like in the embodiments illustrated in FIGS. 2 to 9B, in the heating device 67E for heating the recording medium P immediately before the transfer-fixing process, the heat transmission plate 67*b*E extends from the position near the registration roller pair 64 to the position near the nip N to guide the recording medium P to the nip N.

Like in the transfer-fixing device 66E depicted in FIG. 8, the heat transmission plate 67*b*E has the concave shape.

A linear velocity of the recording medium P at the outer circumferential surface of the registration roller pair 64 is increased by about one percent compared to a linear velocity of the recording medium P opposing the roller 28A at the nip N. In other words, a circumferential velocity of the registration roller pair 64 is increased by about one percent compared to a circumferential velocity of the roller 28A.

In the transfer-fixing device 66G, the vacuum mechanism 90 serves as a biasing member for pressing the recording medium P guided by the heat transmission plate 67*b*E to the nip N against the heat transmission plate 67*b*E. The vacuum mechanism 90 faces the heat transmission plate 67*b*E at a side opposite to a side at which the recording medium P faces the heat transmission plate 67*b*E, and exerts a vacuum force on the recording medium P guided by the heat transmission plate 67*b*E via through-holes provided in the heat transmission plate 67*b*E.

For example, the vacuum mechanism 90 serving as a biasing member includes the duct 96 covering an upper side of the heating device 67E and the vacuum fan 95 provided on an intake of the duct 96. A through-hole having a diameter of 30 μm is provided per area of 25 mm×25 mm on the heat transmission plate 67*b*E. Accordingly, when the vacuum fan 95 is turned on, the vacuum mechanism 90 attracts or biases the recording medium P to the heat transmission plate 67*b*E.

In the transfer-fixing device 66G, the vacuum mechanism 90 attracts the recording medium P to the heat transmission plate 67*b*E without contacting the recording medium P. Accordingly, paper dust does not generate on the back side of the recording medium P. Alternatively, in order to adhere the recording medium P to the heat transmission plate 67*b*E by attracting only the leading edge and the trailing edge of the recording medium P to the heat transmission plate 67*b*E like in the transfer-fixing device 66F illustrated in FIGS. 9A and 9B, the vacuum mechanism 90 may be turned on and off to attract only the leading edge and the trailing edge of the recording medium P guided by the heat transmission plate 67*b*E in the recording medium conveyance direction to the heat transmission plate 67*b*E.

As described above, in the transfer-fixing device 66G, the heat transmission member (e.g., the heat transmission plate 67*b*E) heats the transfer-fixing side of the recording medium P while the heat transmission member guides the recording medium P to the nip N formed between the transfer-fixing member (e.g., the transfer-fixing belt 27) and the pressing member (e.g., the pressing roller 68). The vacuum mechanism 90 serving as a biasing member attracts or biases the recording medium P guided by the heat transmission plate 67*b*E to the heat transmission plate 67*b*E, thus reducing energy consumption, suppressing formation of a faulty fixed toner image or a toner image having uneven gloss, and providing proper fixing property.

Figure 11:
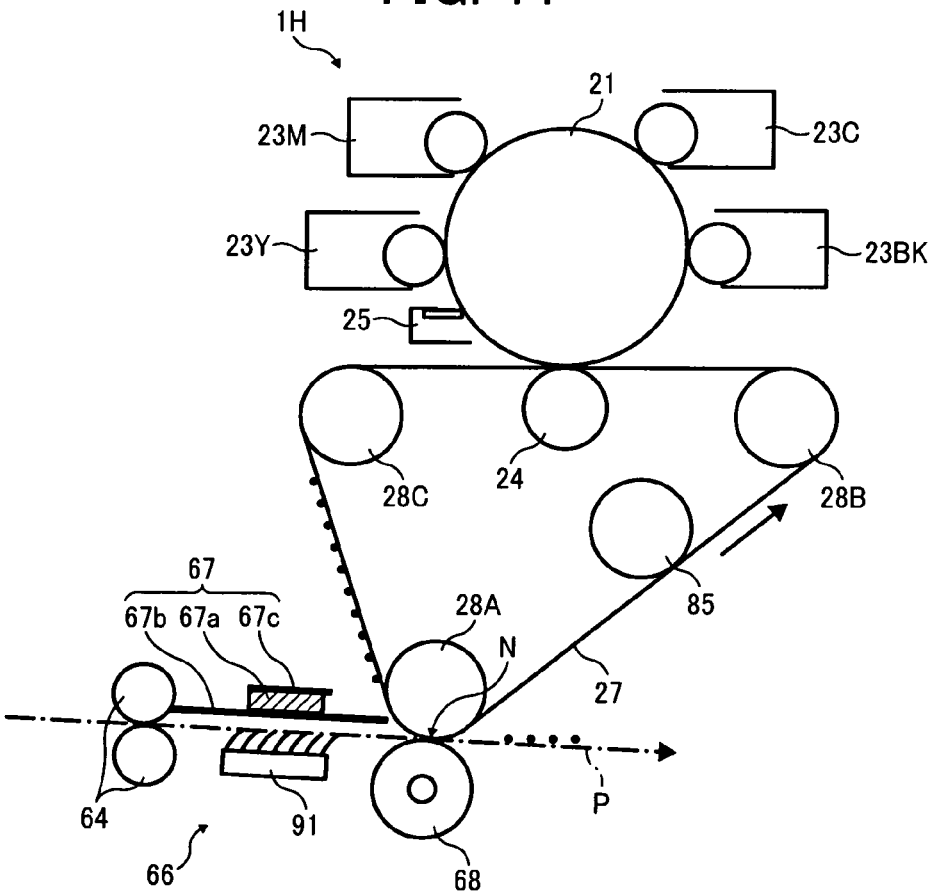
FIG. 11 is a partially schematic view of an image forming apparatus according to yet another example embodiment.

FIG. 11 is a partially schematic view of an image forming apparatus 1H. Unlike the image forming apparatus 1 depicted in FIG. 1 including the four photoconductive drums 21, the image forming apparatus 1H includes a single photoconductive drum 21.

Like in the embodiments illustrated in FIGS. 2 to 10, in the heating device 67 for heating the recording medium P immediately before the transfer-fixing process, the heat transmission plate 67*b* extends from the position near the registration roller pair 64 to the position near the nip N to guide the recording medium P to the nip N. The brush member 91 serving as a biasing member opposes the heat transmission plate 67*b*.

As illustrated in FIG. 11, in the image forming apparatus 1H, a writer, a charger, the development devices 23Y, 23M, 23C, and 23BK, and the cleaner 25 surround the single photoconductive drum 21. Yellow, magenta, cyan, and black toner images are superimposed on the photoconductive drum 21 to form a color toner image. The transfer bias roller 24 transfers the color toner image onto the transfer-fixing belt 27 at a position at which the photoconductive drum 21 opposes the transfer bias roller 24.

Thereafter, like in the embodiments illustrated in FIGS. 2 to 10, the color toner image on the transfer-fixing belt 27 is transferred and fixed onto the recording medium P heated by the heating device 67 at the nip N formed between the transfer-fixing belt 27 and the pressing roller 68.

As described above, like in the embodiments illustrated in FIGS. 2 to 10, in the transfer-fixing device 66, the heat transmission member (e.g., the heat transmission plate 67*b*) heats the transfer-fixing side of the recording medium P while the heat transmission member guides the recording medium P to the nip N formed between the transfer-fixing member (e.g., the transfer-fixing belt 27) and the pressing member (e.g., the pressing roller 68). The biasing member (e.g., the brush member 91) presses or biases the recording medium P guided by the heat transmission member against the heat transmission member, thus reducing energy consumption, suppressing formation of a faulty fixed toner image or a toner image having uneven gloss, and providing proper fixing property.

Figure 12:
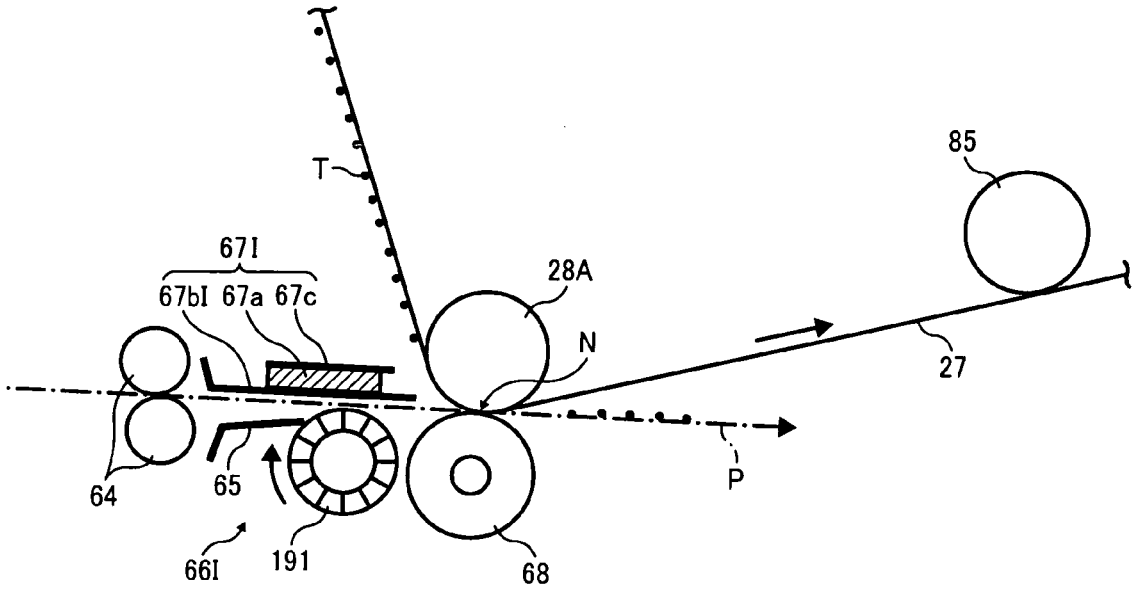
FIG. 12 is a sectional view of a transfer-fixing device according to yet another example embodiment.

FIG. 12 is a sectional view of a transfer-fixing device 66I. As illustrated in FIG. 12, the transfer-fixing device 66I includes a heating device 67I, a guide 65, and a brush roller 191. The heating device 67I includes the heating member 67*a*, a heat transmission plate 67*b*I, and the electrode 67*c*. The heating device 67I replaces the heating device 67 depicted in FIG. 2. The brush roller 191 replaces the brush member 91 depicted in FIG. 2. The other elements of the transfer-fixing device 66I are equivalent to the elements of the transfer-fixing device 66 depicted in FIG. 2.

The brush roller 191 serves as a biasing member or a brush member.

Like in the embodiment illustrated in FIGS. 2 to 6, in the heating device 67I for heating the recording medium P immediately before the transfer-fixing process, the heat transmission plate 67*b*I extends from the position near the registration roller pair 64 to the position near the nip N to guide the recording medium P to the nip N. The brush roller 191 serving as a biasing member opposes the heat transmission plate 67*b*I.

Unlike the un-rotatable, plate-shaped brush member 91 depicted in FIG. 2, the brush roller 191 contacts the recording medium P and rotates clockwise in FIG. 12 in a direction identical to the recording medium conveyance direction.

In the transfer-fixing device 66I, the brush roller 191 serving as a biasing member presses or biases the recording medium P guided by the heat transmission plate 67*b*I to the nip N against the heat transmission plate 67*b*I. Accordingly, the recording medium P is adhered to the heat transmission plate 67*b*I with an improved adhesive force for a longer time. Consequently, the heat transmission plate 67*b*I increases the surface temperature of the recording medium P to a target temperature precisely, suppressing faulty fixing.

Figure 13A:
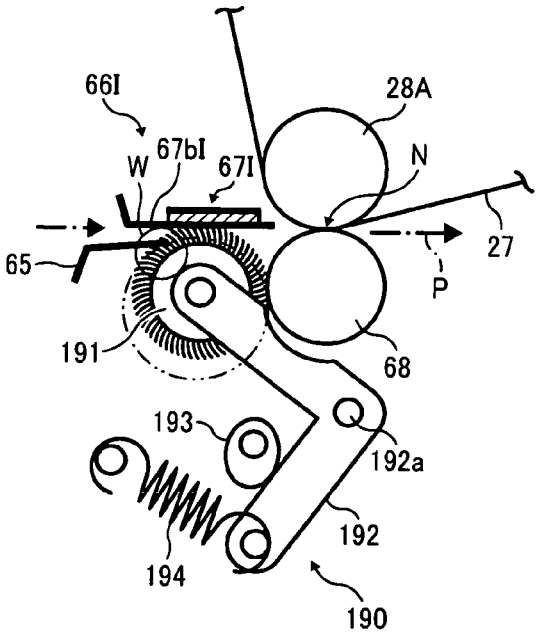
FIG. 13A is an enlarged sectional view (according to an example embodiment) of the transfer-fixing device shown in FIG. 12 when a biasing member included in the transfer-fixing device contacts a recording medium.
Figure 13B:
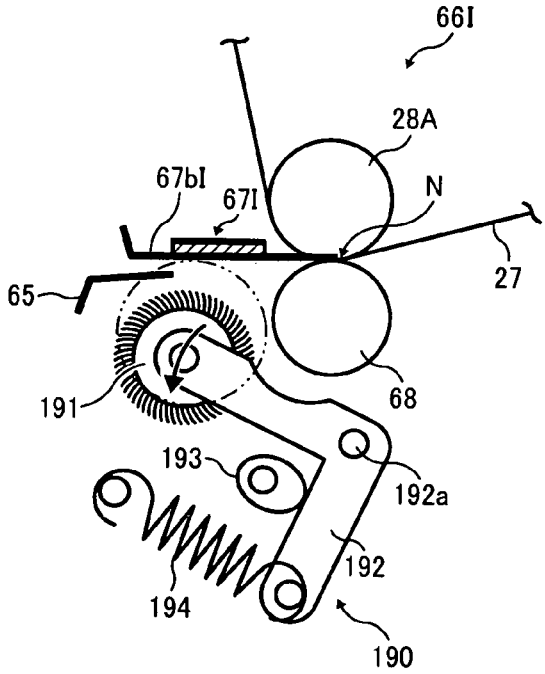
FIG. 13B is an enlarged sectional view (according to an example embodiment) of the transfer-fixing device shown in FIG. 13A when the biasing member is separated from the recording medium.

FIGS. 13A and 13B illustrate an enlarged sectional view of the transfer-fixing device 66I. As illustrated in FIGS. 13A and 13B, the transfer-fixing device 66I further includes a lifting mechanism 190. The lifting mechanism 190 includes a lever 192, a support shaft 192*a*, a cam 193, and a spring 194.

The brush roller 191 serving as a biasing member is a heat-resistant roller member rotatable clockwise in FIG. 12 at a speed identical to a conveyance speed of the recording medium P and including a core metal and a brush cloth wound around the core metal in a spiral shape. The brush cloth includes polyimide fiber and aramid fiber. The heat transmission plate 67*b*I and the guide 65 guide the recording medium P passing through the registration roller pair 64. The recording medium P is heated by the heat transmission plate 67*b*I at a position immediately before the nip N while the brush roller 191 presses and biases the recording medium P against the heat transmission plate 67*b*I, and then enters the nip N.

The brush roller 191 has an outer diameter of 30 mm, and includes bristles having a length of 10 mm, a string thickness of 1,330 T/120 F, and a density in a range from 100,000 to 150,000 per square inch. Alternatively, the brush roller 191 may include other bristles not limited to the above-described bristles, for example, bristles including fluorocarbon resin, heat-resistant resin, heat-resistant metal, or a low-friction material coated on a surface of such resin or metal. Heat resistance of the brush roller 191 reduces thermal degradation of the bristles of the brush roller 191 due to heat generated by the heat transmission plate 67*b*I.

The brush roller 191 may be driven and rotated in such a manner that a linear velocity (e.g., a circumferential velocity) of the brush roller 191 at a position at which the brush roller 191 contacts the recording medium P is equivalent to a conveyance speed of the recording medium P or greater. In other words, the brush roller 191 may rotate clockwise in FIG. 12 at a speed equivalent to or greater than the conveyance speed of the recording medium P.

Accordingly, when the recording medium P reaches a contact position at which the brush roller 191 contacts the heat transmission plate 67*b*I, the recording medium P is not caught in the brush roller 191, thus preventing degradation of conveyance property for conveying the recording medium P. In the transfer-fixing device 66I, the linear velocity (e.g., the circumferential velocity) of the brush roller 191 at a position at which the brush roller 191 contacts the recording medium P is greater by a range from 1 percent to 3 percent than the conveyance speed of the recording medium P.

As illustrated in FIG. 12, the recording medium P is conveyed in a substantially horizontal direction from left to right. The heat transmission plate 67*b*I is provided above the conveyed recording medium P. The brush roller 191 is provided below the conveyed recording medium P. The brush roller 191 is provided in a gravity direction of the recording medium P so that a counteractive force in a direction counter to a direction in which the brush roller 191 lifts the recording medium P is applied to the brush roller 191. Accordingly, the recording medium P contacts the brush roller 191 with a great contact force to improve conveyance property for conveying the recording medium P. In the transfer-fixing device 66I, the recording medium. P is conveyed in the substantially horizontal direction. Alternatively, in an image forming apparatus in which the recording medium P is conveyed in an oblique direction, the brush roller 191 is provided in a direction in which a component force of the gravity direction of the recording medium P is applied so as to provide effects equivalent to the above-described effects.

The brush roller 191 serving as a biasing member point-contacts or line-contacts the recording medium P guided by the heat transmission plate 67*b*I at a plurality of positions. The brush roller 191 contacts the recording medium P in an area as small as possible to press the recording medium P against the heat transmission plate 67*b*I, preventing transmission of heat from the recording medium P to the brush roller 191, suppressing degradation of heating efficiency for heating the recording medium P, and suppressing degradation of conveyance property for conveying the recording medium P.

In the transfer-fixing device 66I, a pressing width (e.g., a nip width) in which the brush roller 191 presses against the heat transmission plate 67*b*I is set to a range from 3 mm to 12 mm which corresponds to a pressure in a range from about 3 kgf to about 5 kgf.

Alternatively, instead of the brush roller 191, a roller member including a surface layer formed of urethane foam or felt may be used as a biasing member.

In the transfer-fixing device 66I, a biasing condition in which the brush roller 191 serving as a biasing member presses the recording medium P against the heat transmission plate 67*b*I is changeable according to the thickness or type of the recording medium P guided by the heat transmission plate 67*b*I.

As illustrated in FIGS. 13A and 13B, the transfer-fixing device 66I includes the lifting mechanism 190 which changes a biasing force applied by the brush roller 191 to the recording medium P to press the recording medium P against the heat transmission plate 67*b*I. A detector provided in the image forming apparatus 1 depicted in FIG. 1 detects the thickness of the recording medium P to be sent to the transfer-fixing device 66I. The controller C depicted in FIG. 1 controls the lifting mechanism 190 based on information about the thickness of the recording medium P provided by the detector.

Alternatively, a thickness sensor may be provided on a conveyance path for conveying the recording medium P to detect the thickness of the recording medium P to be sent to the nip N. Yet alternatively, the thickness of the recording medium P may be judged based on information about the recording medium P input by a user on a control panel provided on the image forming apparatus 1.

The lifting mechanism 190 includes the lever 192, the cam 193, the spring 194, and a motor, and changes a position of the brush roller 191 relative to the heat transmission plate 67*b*I. The lever 192 is mounted on a side plate of the transfer-fixing device 66I in such a manner that the lever 192 is rotatable about the support shaft 192*a*. The brush roller 191 is rotatably attached to one end of the lever 192, and one hook of the spring 194 is attached to another end of the lever 192. Another hook of the spring 194 is attached to the side plate of the transfer-fixing device 66I. The cam 193 connected to the motor engages a center portion of the lever 192. Accordingly, when the motor drives and rotates the cam 193 to set a position of the cam 193 in a rotation direction of the cam 193, a spring force of the spring 194 rotates the lever 192 about the support shaft 192*a* while the lever 192 contacts the cam 193. Thus, the brush roller 191 is lifted and lowered.

For example, FIG. 13A illustrates the brush roller 191 contacting the heat transmission plate 67*b*I in a given pressing width, that is, in a given nip width. When the cam 193 rotates for a given angle, the pressing width, that is, a biasing force applied by the brush roller 191 to the recording medium P, is increased or decreased. When a thick recording medium P is guided by the heat transmission plate 67*b*I, the controller C depicted in FIG. 1 controls the lifting mechanism 190 serving as a pressing width adjuster to cause the brush roller 191 to press the thick recording medium P against the heat transmission plate 67*b*I in a greater pressing width with a greater biasing force than when a thin recording medium P is guided by the heat transmission plate 67*b*I.

In the thick recording medium P (e.g., thick paper), heat applied by the heat transmission plate 67*b*I to the transfer-fixing side (e.g., the front side) of the recording medium P is transmitted to the back side of the recording medium P more easily over time compared to the thin recording medium P (e.g., thin paper). Accordingly, the temperature of the transfer-fixing side of the thick recording medium P decreases in a greater amount compared to the thin recording medium P before the thick recording medium P reaches the nip N. By contrast, the heat transmission plate 67*b*I heats the thin recording medium P with greater heating efficiency compared to the thick recording medium P. Therefore, when the controller C controls the temperature of the heat transmission plate 67*b*I based on the thick recording medium P, the heat transmission plate 67*b*I may heat the thin recording medium P excessively or may curl the thin recording medium P due to excessive heating.

To address this problem, the above-described control is performed to prevent temperature unevenness of the recording medium P heated by the heat transmission plate 67*b*I immediately before the transfer-fixing process even when recording media P of various thicknesses are sent to the transfer-fixing device 66I so as to transfer and fix a toner image on the recording medium P stably. Namely, change in the pressing width (e.g., the biasing force) of the brush roller 191 in which the brush roller 191 presses the recording medium P against the heat transmission plate 67*b*I influences change in an amount of heat applied by the heat transmission plate 67*b*I to the recording medium P.

In the transfer-fixing device 66I, the pressing width of the brush roller 191 in which the brush roller 191 presses the recording medium P against the heat transmission plate 67*b*I is changed according to the thickness of the recording medium P. Accordingly, the temperature of the transfer-fixing side of the recording medium P is optimized before the recording medium P enters the nip N for the transfer-fixing process regardless of the thickness of the recording medium P. Further, the recording medium P is heated with a minimum amount of heat to transfer and fix the toner image on the recording medium P properly, improving energy efficiency of the transfer-fixing device 66I. Further, when the thin recording medium P passes through the transfer-fixing device 66I, the thin recording medium P is heated with a minimum amount of heat to prevent the thin recording medium P from curling after being heated.

In the transfer-fixing device 66I, the pressing width of the brush roller 191 in which the brush roller 191 presses the recording medium P against the heat transmission plate 67*b*I is changed according to the thickness or type of the recording medium P. Alternatively, a number of rotations of the brush roller 191 may be changed according to the thickness or type of the recording medium P.

For example, the motor for driving the brush roller 191 may be a number-of-rotation changeable motor which changes the number of rotations of the brush roller 191. When the heat transmission plate 67*b*I guides the thick recording medium P, the controller C controls the motor to cause the number of rotations of the brush roller 191 to be greater than the number of rotations of the brush roller 191 when the heat transmission plate 67*b*I guides the thin recording medium P. Accordingly, when the thick recording medium P passes through the transfer-fixing device 66I, the brush roller 191 rotating at the greater number of rotations presses the thick recording medium P against the heat transmission plate 67*b*I actively, providing effects equivalent to the above-described effects.

FIG. 13B illustrates the brush roller 191 being separated from the heat transmission plate 67*b*I and the pressing roller 68 completely by movement of the lifting mechanism 190.

When the recording medium P does not pass between the heat transmission plate 67*b*I and the brush roller 191, the brush roller 191 is separated relatively from the heat transmission plate 67*b*I, the pressing roller 68, and the guide 65.

Accordingly, the brush roller 191 contacts the heat transmission plate 67*b*I at a minimum time to reduce thermal degradation of the brush roller 191 due to heat transmitted from the heat transmission plate 67*b*I to the brush roller 191. The brush roller 191 contacts the heat transmission plate 67*b*I, the pressing roller 68, and the guide 65 at the minimum time, and is deformed, preventing long-time deformation of bristles of the brush roller 191 from disturbing restoration of the deformed bristles to an original shape.

As illustrated in FIGS. 12 and 13A, the guide 65 is provided upstream from the brush roller 191 in the recording medium conveyance direction, and contacts the bristles of the brush roller 191 and guides the recording medium P. Specifically, a leading edge portion W of the guide 65 facing the nip N contacts the bristles of the brush roller 191.

With this structure, after the bristles of the brush roller 191 separate from the guide 65, the bristles of the brush roller 191 contact the heat transmission plate 67*b*I. In other words, the guide 65 prevents the bristles of the brush roller 191 from being arranged densely at a position upstream from a contact position at which the brush roller 191 contacts the heat transmission plate 67*b*I in the recording medium conveyance direction. Accordingly, the recording medium P reaching the contact position at which the brush roller 191 contacts the heat transmission plate 67*b*I does not receive a substantial resistance from the bristles of the brush roller 191, and therefore is conveyed smoothly.

As described above, like in the embodiments illustrated in FIGS. 2 to 11, in the transfer-fixing device 66I, the heat transmission member (e.g., the heat transmission plate 67*b*I) heats the transfer-fixing side of the recording medium P while the heat transmission member guides the recording medium P to the nip N formed between the transfer-fixing member (e.g., the transfer-fixing belt 27) and the pressing member (e.g., the pressing roller 68). The brush member or the biasing member (e.g., the brush roller 191) presses or biases the recording medium P guided by the heat transmission member against the heat transmission member, thus reducing energy consumption, suppressing formation of a faulty fixed toner image or a toner image having uneven gloss, and providing proper fixing property.

Figure 14:
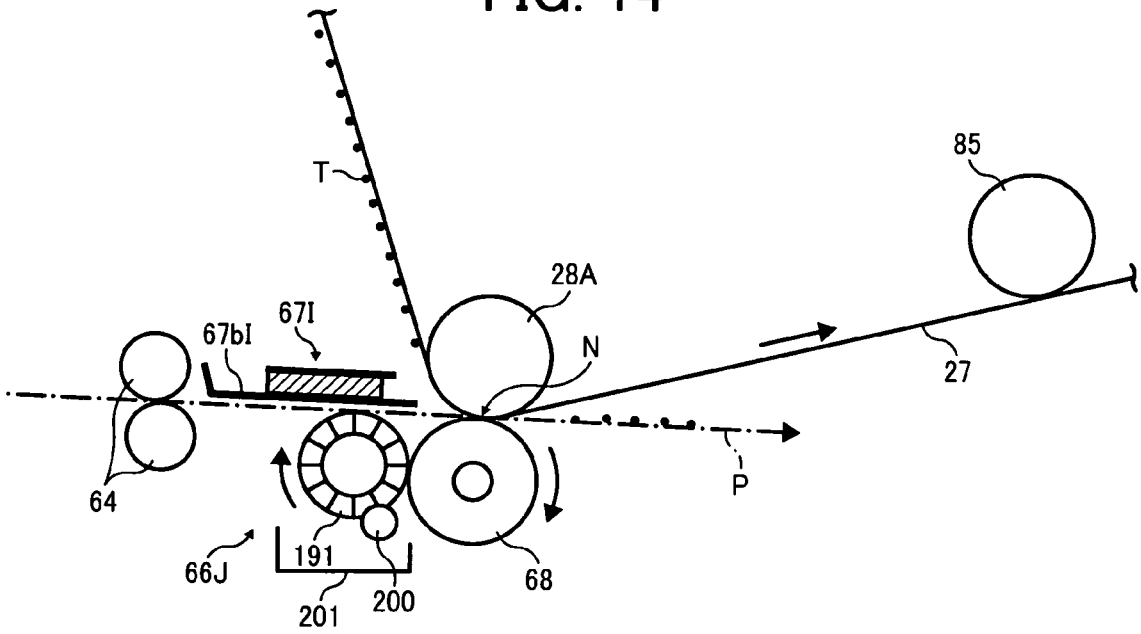
FIG. 14 is a sectional view of a transfer-fixing device according to yet another example embodiment.

FIG. 14 is a sectional view of a transfer-fixing device 66J. As illustrated in FIG. 14, the transfer-fixing device 66J includes a cleaner 200 and a tray 201. The other elements of the transfer-fixing device 66J are equivalent to the elements of the transfer-fixing device 66I depicted in FIG. 12.

Unlike in the transfer-fixing device 66I, in the transfer-fixing device 66J, the brush roller 191 serving as a biasing member contacts the pressing roller 68, and the cleaner 200 slides over the brush roller 191.

Like in the transfer-fixing device 66I, in the transfer-fixing device 66J, the heating device 67I for heating the recording medium P immediately before the transfer-fixing process includes the heat transmission plate 67*b*I extending from the position near the registration roller pair 64 to the position near the nip N to guide the recording medium P. The brush roller 191 serving as a biasing member or a brush member opposes the heat transmission plate 67*b*I.

Unlike the brush roller 191 of the transfer-fixing device 66I, the brush roller 191 of the transfer-fixing device 66J slidabaly contacts or slides over the pressing roller 68 serving as a pressing member. Specifically, the bristles of the brush roller 191 slide over an outer circumferential surface of the pressing roller 68.

With this structure, the brush roller 191 cleans the surface of the pressing roller 68. Specifically, toner (e.g., background soiling toner) is adhered to the transfer-fixing belt 27. Accordingly, when the recording medium P having a small width passes through the nip N formed between the transfer-fixing belt 27 and the pressing roller 68, the toner adhered to a region of the transfer-fixing belt 27 provided beyond the width of the recording medium P may be adhered to the pressing roller 68. To address this problem, even when the toner is adhered to the surface of the pressing roller 68, the brush roller 191 sliding over the surface of the pressing roller 68 cleans the pressing roller 68. Accordingly, the toner may not be adhered from the pressing roller 68 to the back side of the recording medium P at the nip N. Further, the brush roller 191 also serves as a cleaner for cleaning the pressing roller 68. Accordingly, a cleaner for cleaning the pressing roller 68 is not provided separately from the brush roller 191, resulting in reduced manufacturing costs of the transfer-fixing device 66J and the compact transfer-fixing device 66J.

The transfer-fixing device 66J includes the cleaner 200 for cleaning the brush roller 191 by sliding over the bristles of the brush roller 191. Specifically, the cleaner 200 is provided downstream from a slide position at which the brush roller 191 slides over the pressing roller 68 in a rotation direction of the brush roller 191. The cleaner 200 is a flicker bar (e.g., a bar member) digging into the bristles of the brush roller 191.

The cleaner 200 removes from the brush roller 191 paper dust generated by the recording medium P contacting the heat transmission plate 67*b*I and adhered to the brush roller 191 and toner (e.g., background soiling toner) removed by the brush roller 191 from the pressing roller 68 and adhered to the brush roller 191. Thereafter, the paper dust and the toner removed by the cleaner 200 from the brush roller 191 fall down in the gravity direction and are received and collected by the tray 201.

In the transfer-fixing device 66J, the flicker bar is used as the cleaner 200. Alternatively, a plate-shaped blade or a scraper may be used as the cleaner 200.

As described above, like in the embodiments illustrated in FIGS. 2 to 13B, in the transfer-fixing device 66J, the heat transmission member (e.g., the heat transmission plate 67*b*I) heats the transfer-fixing side of the recording medium P while the heat transmission member guides the recording medium P to the nip N formed between the transfer-fixing member (e.g., the transfer-fixing belt 27) and the pressing member (e.g., the pressing roller 68). The brush member or the biasing member (e.g., the brush roller 191) presses or biases the recording medium P guided by the heat transmission member against the heat transmission member, thus reducing energy consumption, suppressing formation of a faulty fixed toner image or a toner image having uneven gloss, and providing proper fixing property.

Figure 15A:
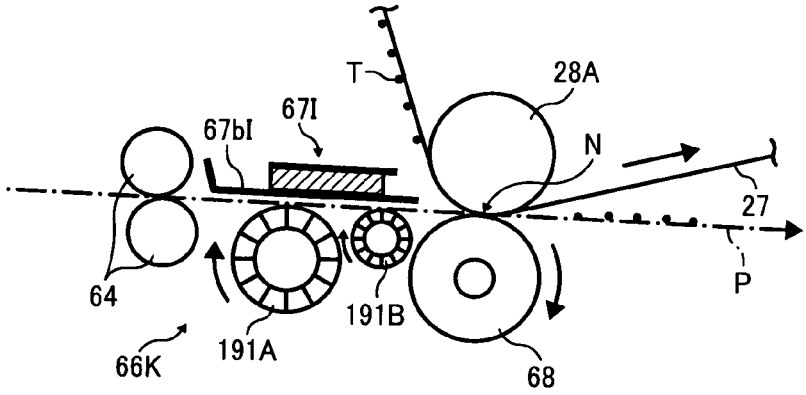
FIG. 15A is a sectional view of a transfer-fixing device according to yet another example embodiment.

FIG. 15A is a sectional view of a transfer-fixing device 66K. As illustrated in FIG. 15A, the transfer-fixing device 66K includes a first brush roller 191A and a second brush roller 191B replacing the brush roller 191 depicted in FIG. 12. The other elements of the transfer-fixing device 66K are equivalent to the elements of the transfer-fixing device 66I depicted in FIG. 12.

Unlike the transfer-fixing device 66I, the transfer-fixing device 66K includes the two brush rollers, that is, the first brush roller 191A and the second brush roller 191B.

Like in the transfer-fixing device 66I, in the transfer-fixing device 66K, the heating device 67I for heating the recording medium P immediately before the transfer-fixing process includes the heat transmission plate 67*b*I extending from the position near the registration roller pair 64 to the position near the nip N to guide the recording medium P. The first brush roller 191A and the second brush roller 191B serving as biasing members or brush members oppose the heat transmission plate 67*b*I.

Unlike the transfer-fixing device 66I including the single brush roller 191, the transfer-fixing device 66K includes a plurality of brush rollers, that is, the first brush roller 191A and the second brush roller 191B serving as biasing members.

Specifically, the first, upstream brush roller 191A has a great outer diameter. The second, downstream brush roller 191B is provided downstream from the first brush roller 191A in the recording medium conveyance direction for conveying the recording medium P guided by the heat transmission plate 67*b*I at a position near the nip N formed between the transfer-fixing belt 27 and the pressing roller 68. The second brush roller 191B has a small outer diameter. The first brush roller 191A and the second brush roller 191B contact the heat transmission plate 67*b*I and rotate clockwise in FIG. 15A to press or bias the recording medium P guided by the heat transmission plate 67*b*I against the heat transmission plate 67*b*I.

With this structure, the second brush roller 191B having the small outer diameter presses the recording medium P against the heat transmission plate 67*b*I at the position near the nip N formed between the transfer-fixing belt 27 and the pressing roller 68. Accordingly, the surface of the recording medium P is heated sufficiently until the recording medium P reaches a position immediately before the nip N.

Figure 15B:
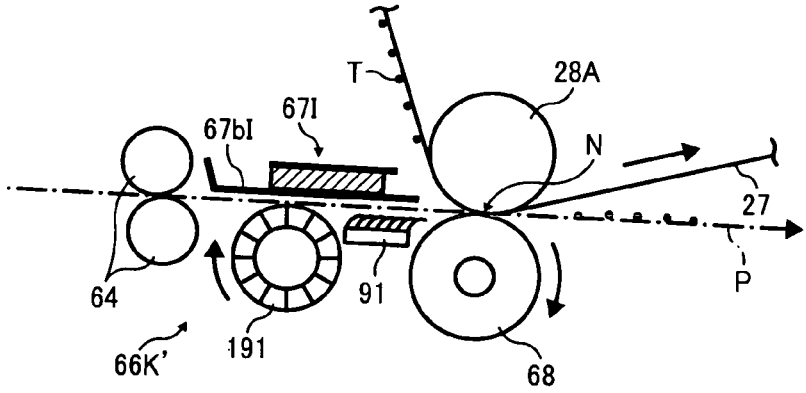
FIG. 15B is a sectional view of a transfer-fixing device according to yet another example embodiment.

In the transfer-fixing device 66K, the second brush roller 191B having the small outer diameter is provided at the position near the nip N formed between the transfer-fixing belt 27 and the pressing roller 68. Alternatively, the plate-shaped brush member 91 may be provided at the position near the nip N as illustrated in FIG. 15B. FIG. 15B is a sectional view of a transfer-fixing device 66K' including the brush member 91. The transfer-fixing device 66K' includes the brush member 91 replacing the second brush roller 191B depicted in FIG. 15A. The other elements of the transfer-fixing device 66K' are equivalent to the elements of the transfer-fixing device 66K depicted in FIG. 15A.

In the transfer-fixing device 66K' illustrated in FIG. 15B, the brush roller 191 is provided upstream from the brush member 91 in the recording medium conveyance direction for conveying the recording medium P guided by the heat transmission plate 67*b*I. The plate-shaped brush member 91 is provided downstream from the brush roller 191 in the recording medium conveyance direction at a position near the nip N.

With this structure, the plate-shaped brush member 91 presses or biases the recording medium P against the heat transmission plate 67*b*I at the position near the nip N formed between the transfer-fixing belt 27 and the pressing roller 68. Accordingly, the surface of the recording medium P is heated sufficiently until the recording medium P reaches a position immediately before the nip N.

As described above, like in the embodiments illustrated in FIGS. 2 to 14, in the transfer-fixing device 66K or 66K', the heat transmission member (e.g., the heat transmission plate 67*b*I) heats the transfer-fixing side of the recording medium P while the heat transmission member guides the recording medium P to the nip N formed between the transfer-fixing member (e.g., the transfer-fixing belt 27) and the pressing member (e.g., the pressing roller 68). The plurality of brush members or biasing members (e.g., the first brush roller 191A and the second brush roller 191B, or the brush roller 191 and the brush member 91) presses or biases the recording medium P guided by the heat transmission member against the heat transmission member, thus reducing energy consumption, suppressing formation of a faulty fixed toner image or a toner image having uneven gloss, and providing proper fixing property.

Figure 16:
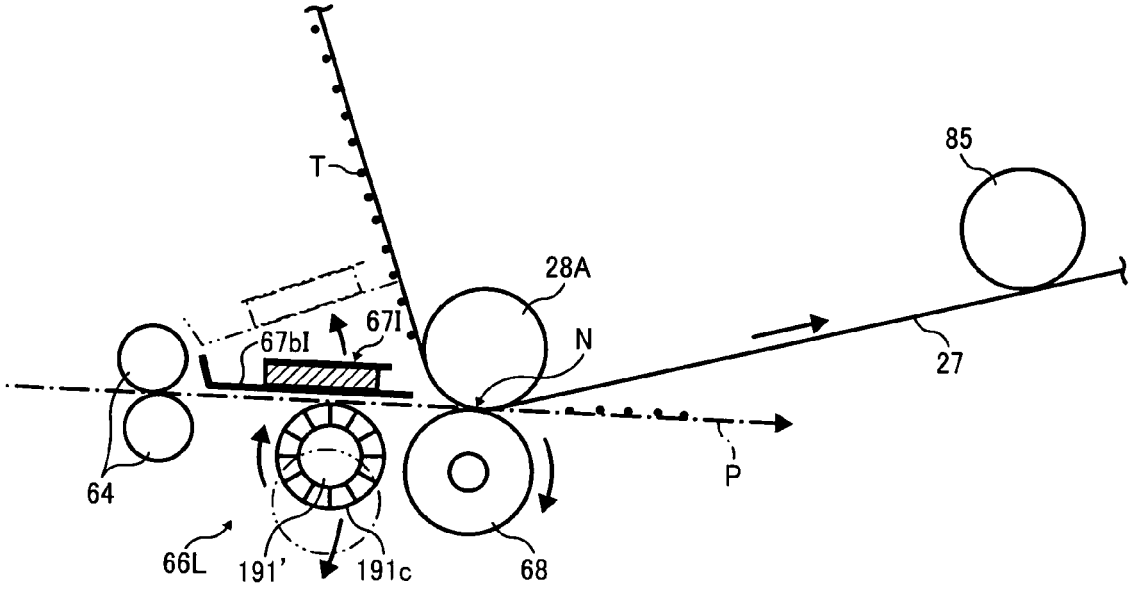
FIG. 16 is a sectional view of a transfer-fixing device according to yet another example embodiment.

FIG. 16 is a sectional view of a transfer-fixing device 66L. As illustrated in FIG. 16, the transfer-fixing device 66L includes a brush roller 191' replacing the brush roller 191 depicted in FIG. 12. The brush roller 191' includes a cylindrical member 191*c*. The other elements of the transfer-fixing device 66L are equivalent to the elements of the transfer-fixing device 66I depicted in FIG. 12.

Figure 17:
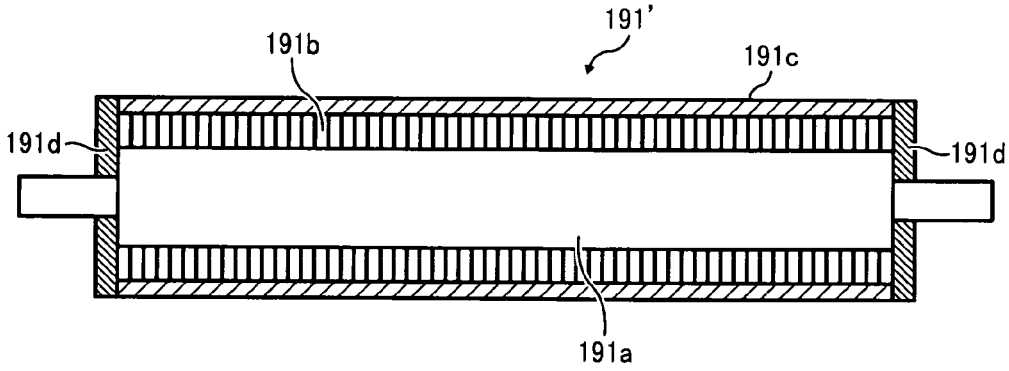
FIG. 17 is a sectional view (according to an example embodiment) of a brush roller included in the transfer-fixing device shown in FIG. 16 in a width direction of the brush roller.

FIG. 17 is a sectional view of the brush roller 191' in a width direction of the brush roller 191'. As illustrated in FIG. 17, the brush roller 191' includes a core metal 191*a*, bristles 191*b*, the cylindrical member 191*c*, and flanges 191*d*.

Unlike the transfer-fixing device 66I, the transfer-fixing device 66L includes the flexible cylindrical member 191*c* covering an outer circumferential surface of the brush roller 191'.

Like in the transfer-fixing device 66I, in the transfer-fixing device 66L, the heating device 67I for heating the recording medium P immediately before the transfer-fixing process includes the heat transmission plate 67*b*I extending from the position near the registration roller pair 64 to the position near the nip N to guide the recording medium P. The brush roller 191' serving as a biasing member or a brush member opposes the heat transmission plate 67*b*I.

Unlike the brush roller 191 depicted in FIG. 12, the brush roller 191' includes the flexible cylindrical member 191*c* covering the outer circumferential surface of the brush roller 191'. Specifically, as illustrated in FIG. 17, in the brush roller 191', the bristles 191*b* (e.g., brush cloth) are wound around the core metal 191*a*, and the flexible cylindrical member 191*c* covers the bristles 191*b*. The cylindrical member 191*c* is a heat-resistant thin tube member including a low friction material such as a fluorine compound. The cylindrical member 191*c* is driven and rotated clockwise in FIG. 16 together with the core metal 191*a* and the bristles 191*b*. The brush roller 191' having this structure presses against the heat transmission plate 67*b*I to form a nip between the brush roller 191' and the heat transmission plate 67*b*I in a state in which the cylindrical member 191*c* and the bristles 191*b* are deformed.

In the transfer-fixing device 66L also, a distance as small as possible is provided between a contact position at which the cylindrical member 191*c* of the brush roller 191' contacts the heat transmission plate 67*b*I and the nip N formed between the transfer-fixing belt 27 and the pressing roller 68.

At the contact position at which the cylindrical member 191*c* of the brush roller 191' contacts the heat transmission plate 67*b*I, the cylindrical member 191*c* and the bristles 191*b* are deformed sufficiently by a slight contact force in a range from about 3 kgf to about 5 kgf to provide a period of time enough to heat the recording medium P.

As illustrated in FIG. 17, the flanges 191*d* are pressingly inserted into both ends of the brush roller 191' in an axial direction of the brush roller 191' to prevent the cylindrical member 191*c* from dropping off the brush roller 191' and prevent shift of the cylindrical member 191*c* in the axial direction of the brush roller 191'.

As described above, with the flexible cylindrical member 191*c* covering the outer circumferential surface of the brush roller 191', even when a thin recording medium P such as coated paper passes through the transfer-fixing device 66L, the heat transmission plate 67*b*I heats the recording medium P properly at the contact position at which the brush roller 191' contacts the heat transmission plate 67*b*I without degrading smoothness of the surface of the recording medium P.

Specifically, when the bristles of the brush roller 191 slide over the thin recording medium P passing through the contact position at which the brush roller 191 contacts the heat transmission plate 67*b*I as illustrated in FIG. 12, the bristles of the brush roller 191 may generate asperities on the surface of the recording medium P, degrading smoothness of the surface of the recording medium P. To address this problem, in the transfer-fixing device 66L depicted in FIG. 16, the flexible cylindrical member 191*c* covers the outer circumferential surface of the brush roller 191'. Accordingly, the bristles 191*b* of the brush roller 191' do not point-contact or line-contact the recording medium P directly, and the cylindrical member 191*c* of the brush roller 191' plane-contacts the recording medium P substantially uniformly. Consequently, the transfer-fixing device 66L heats the recording medium P properly without degrading smoothness of the surface of the recording medium P.

When the bristles of the brush roller 191 slide over the recording medium P passing through the contact position at which the brush roller 191 contacts the heat transmission plate 67*b*I directly as illustrated in FIG. 12, the bristles of the brush roller 191 may fall off the brush roller 191 or may be broken after the transfer-fixing device 66I is used for a long time. When the fallen bristles are adhered to the recording medium P or parts of the image forming apparatus 1 depicted in FIG. 1, a faulty toner image may be formed or the image forming apparatus 1 may become out of order.

To address this problem, in the transfer-fixing device 66L, the cylindrical member 191*c* covers the outer circumferential surface of the brush roller 191' so as to prevent the bristles 191*b* of the brush roller 191' from falling off or being broken.

In the brush roller 191', an air gap facing an inner circumferential surface of the cylindrical member 191*c* is provided by the bristles 191*b*. Accordingly, when the bristles 191*b* include heat-resistant aramid fiber, a surface of the brush roller 191' provides a slight thermal conductivity, reducing unnecessary transmission of heat from the heat transmission plate 67*b*I to the brush roller 191', and therefore improving energy efficiency of the heating device 67I.

In the transfer-fixing device 66L, the deformable, thin-film cylindrical member 191*c* is provided on an outer circumferential surface of the flexible bristles 191*b* to provide flexibility of the surface of the brush roller 191'. Accordingly, even when the brush roller 191' contacts the heat transmission plate 67*b*I with a relatively small pressing force, the brush roller 191' is deformed easily to form a nip between the heat transmission plate 67*b*I and the brush roller 191' which has a proper nip length in a range from about 8 mm to about 12 mm. The heat transmission plate 67*b*I heats the recording medium P not bearing a toner image at the nip formed between the heat transmission plate 67*b*I and the brush roller 191'. Therefore, the brush roller 191' presses against the heat transmission plate 67*b*I sufficiently with a pressing force in a range from about 50 g/cm$^2$ to about 200 g/cm$^2$. If the brush roller 191' presses against the heat transmission plate 67*b*I with a pressing force greater than the above-described range, the pressing force may curl or crease the thin recording medium P passing through the nip formed between the heat transmission plate 67*b*I and the brush roller 191'.

In the transfer-fixing device 66L, the flexible surface of the brush roller 191' forms a separation portion provided downstream from the contact position at which the brush roller 191' contacts the heat transmission plate 67*b*I in the recording medium conveyance direction. The separation portion of the brush roller 191' has a small curvature to facilitate separation of the recording medium P from the brush roller 191' and the heat transmission plate 67*b*I when the recording medium P is discharged from the contact position at which the brush roller 191' contacts the heat transmission plate 67*b*I.

Like in the transfer-fixing device 66I depicted in FIG. 12, in the transfer-fixing device 66L, when the recording medium P does not pass through the nip formed between the heat transmission plate 67*b*I and the brush roller 191', the controller C depicted in FIG. 1 controls an operation to separate the brush roller 191' from the heat transmission plate 67*b*I, that is, to move the brush roller 191' to a position illustrated in a broken line in FIG. 16.

Accordingly, the brush roller 191' contacts the heat transmission plate 67*b*I at a minimum time to reduce thermal degradation of the brush roller 191' due to heat transmitted from the heat transmission plate 67*b*I to the brush roller 191'. Further, the brush roller 191' contacts the heat transmission plate 67*b*I at the minimum time and is deformed, preventing long-time deformation of the cylindrical member 191*c* and the bristles 191*b* of the brush roller 191' from disturbing restoration of the deformed cylindrical member 191*c* and the deformed bristles 191*b* to original shapes, respectively.

In the transfer-fixing device 66L, a lifting mechanism automatically lifts the heating device 67I to a position illustrated in a broken line in FIG. 16 at which the heating device 67I is separated from a conveyance path for conveying the recording medium P. When the recording medium P is jammed in the conveyance path provided between the registration roller pair 64 and the nip N formed between the transfer-fixing belt 27 and the pressing roller 68, a jam sensor detects the jammed recording medium P, and the controller C controls the lifting mechanism to lower the brush roller 191' and lift the heating device 67I so that the brush roller 191' and the heating device 67I separate from each other. Thereafter, the user removes the jammed recording medium P from the transfer-fixing device 66L.

Thus, the transfer-fixing device 66L facilitates removal of the jammed recording medium P by the user. Further, the heating device 67I does not continue heating the jammed and stopped recording medium P.

In the transfer-fixing device 66L, the cylindrical member 191*c* of the brush roller 191' includes a low friction material, improving durability of the brush roller 191' which slides over the heat transmission plate 67*b*I. However, the brush roller 191' grips the recording medium P with the heat transmission plate 67*b*I at the contact position at which the brush roller 191' contacts the heat transmission plate 67*b*I with a decreased grip force, resulting in decreased conveyance property for conveying the recording medium P. To address this problem, in the transfer-fixing device 66L, a length of the conveyance path provided between the registration roller pair 64 and the nip N formed between the transfer-fixing belt 27 and the pressing roller 68 is smaller than a length of a minimum-size recording medium P available in the image forming apparatus 1 in the recording medium conveyance direction. Accordingly, conveyance property for conveying the recording medium P is determined by a conveyance force of the registration roller pair 64 and a conveyance force of the pressing roller 68 and the transfer-fixing belt 27, and is hardly affected adversely by the surface of the brush roller 191'.

As described above, like in the embodiments illustrated in FIGS. 2 to 15, in the transfer-fixing device 66L, the heat transmission member (e.g., the heat transmission plate 67*b*I) heats the transfer-fixing side of the recording medium P while the heat transmission member guides the recording medium P to the nip N formed between the transfer-fixing member (e.g., the transfer-fixing belt 27) and the pressing member (e.g., the pressing roller 68). The brush member or the biasing member (e.g., the brush roller 191') presses or biases the recording medium P guided by the heat transmission member against the heat transmission member, thus reducing energy consumption, suppressing formation of a faulty fixed toner image or a toner image having uneven gloss, and providing proper fixing property.

Figure 18:
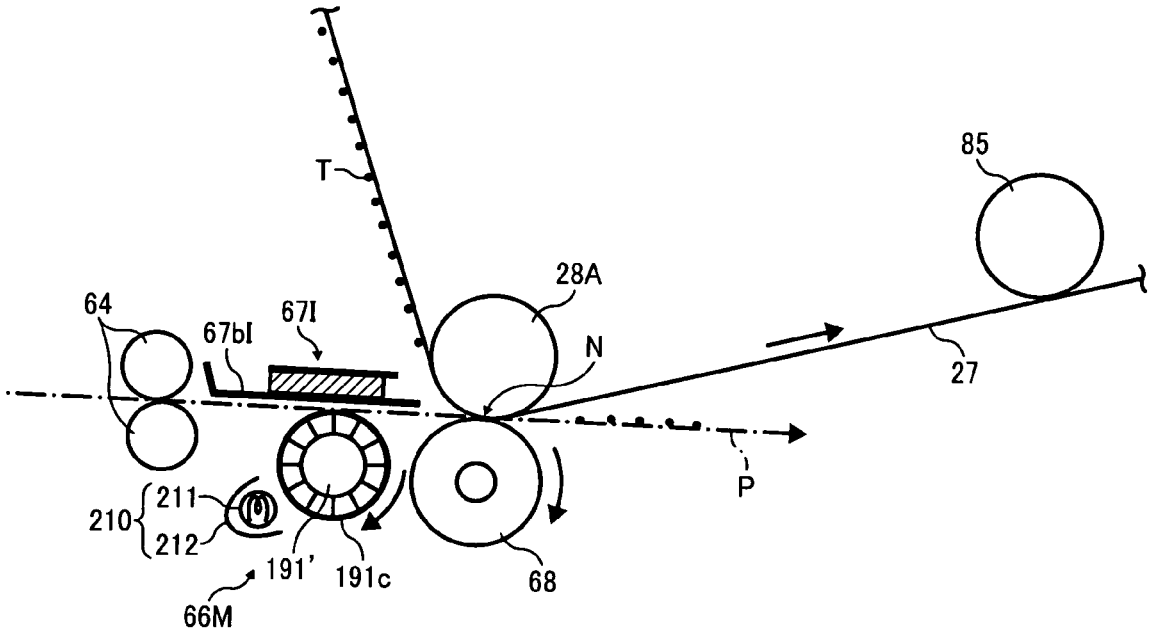
FIG. 18 is a sectional view of a transfer-fixing device according to yet another example embodiment.

FIG. 18 is a sectional view of a transfer-fixing device 66M. As illustrated in FIG. 18, the transfer-fixing device 66M includes a heating assembly 210. The heating assembly 210 includes a heater 211 and a reflection plate 212. The other elements of the transfer-fixing device 66M are equivalent to the elements of the transfer-fixing device 66L depicted in FIG. 16.

Unlike the transfer-fixing device 66L, the transfer-fixing device 66M includes the heating assembly 210 which directly heats the cylindrical member 191*c* covering the outer circumferential surface of the brush roller 191'.

Like in the transfer-fixing device 66L, in the transfer-fixing device 66M, the heating device 67I for heating the recording medium P immediately before the transfer-fixing process includes the heat transmission plate 67*b*I extending from the position near the registration roller pair 64 to the position near the nip N to guide the recording medium P. The brush roller 191' serving as a biasing member or a brush member opposes the heat transmission plate 67*b*I. Like in the transfer-fixing device 66L, in the transfer-fixing device 66M, the brush roller 191' includes the flexible cylindrical member 191*c* covering the bristles 191*b* depicted in FIG. 17 as the outer circumferential surface of the brush roller 191'.

In the transfer-fixing device 66M, the heating assembly 210 heats the cylindrical member 191*c* of the brush roller 191'. Specifically, the heating assembly 210 includes the heater 211 and the reflection plate 212. The heater 211 opposes the outer circumferential surface of the brush roller 191'. The reflection plate 212 reflects light emitted by the heater 211 toward the outer circumferential surface of the brush roller 191'. The outer circumferential surface, that is, the cylindrical member 191*c*, of the brush roller 191' is heated by radiation heat of the heater 211 to heat the back side of the recording medium P passing through the contact position at which the brush roller 191' contacts the heat transmission plate 67*b*I.

In the transfer-fixing device 66M, a heat-resistant metal belt having a desired thermal conductivity is used as the cylindrical member 191*c* to improve heating efficiency for heating the cylindrical member 191*c*. For example, the cylindrical member 191*c* is a metal belt including stainless steel having the thickness of about 0.1 mm.

The heating assembly 210 is provided upstream from the contact position at which the brush roller 191' contacts the heat transmission plate 67*b*I in the rotation direction of the brush roller 191'.

With this structure, in addition to the effects provided by the transfer-fixing device 66L, the transfer-fixing device 66M provides an effect of reducing decrease in heating efficiency for heating the thick recording medium P in a low-temperature environment by heating the back side of the recording medium P opposite to the transfer-fixing side of the recording medium P.

As described above, like in the embodiments illustrated in FIGS. 2 to 17, in the transfer-fixing device 66M, the heat transmission member (e.g., the heat transmission plate 67*b*I) heats the transfer-fixing side of the recording medium P while the heat transmission member guides the recording medium P to the nip N formed between the transfer-fixing member (e.g., the transfer-fixing belt 27) and the pressing member (e.g., the pressing roller 68). The brush member or the biasing member (e.g., the brush roller 191') presses or biases the recording medium P guided by the heat transmission member against the heat transmission member, thus reducing energy consumption, suppressing formation of a faulty fixed toner image or a toner image having uneven gloss, and providing proper fixing property.

Figure 19:
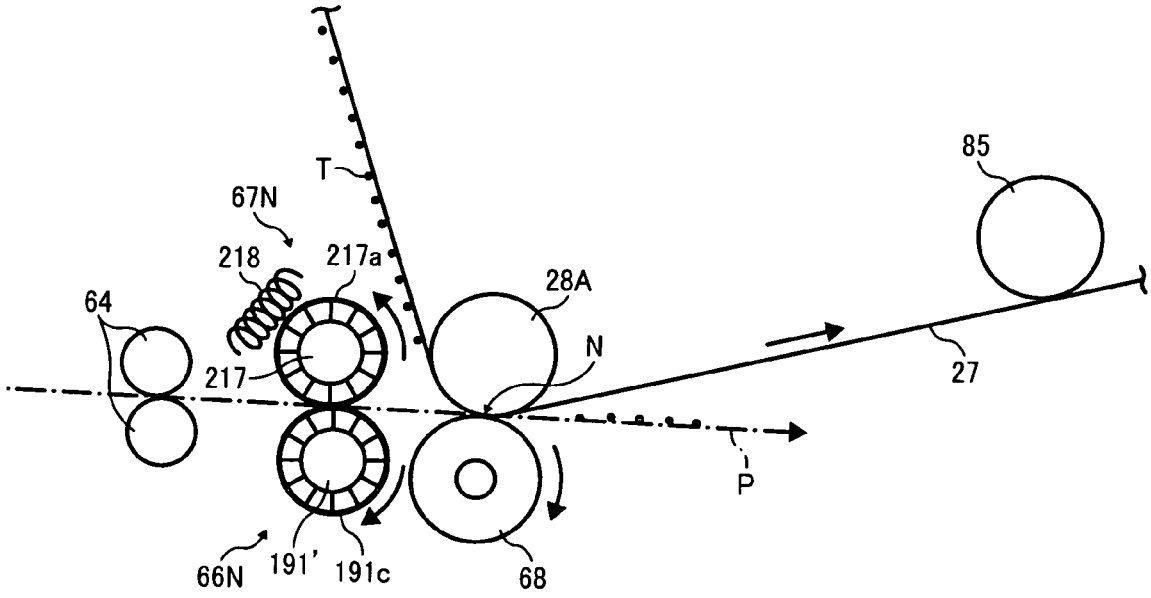
FIG. 19 is a sectional view of a transfer-fixing device according to yet another example embodiment.

FIG. 19 is a sectional view of a transfer-fixing device 66N. As illustrated in FIG. 19, the transfer-fixing device 66N includes a heating device 67N. The heating device 67N includes an elastic roller 217 and an exciting coil 218. The elastic roller 217 includes a metal layer 217*a*. The heating device 67N replaces the heating device 67I depicted in FIG. 16. The other elements of the transfer-fixing device 66N are equivalent to the elements of the transfer-fixing device 66L depicted in FIG. 16.

Unlike the transfer-fixing device 66L, the transfer-fixing device 66N includes the elastic roller 217 including the metal layer 217*a* covering an outer circumferential surface of the elastic roller 217. The metal layer 217*a* serves as a heat transmission plate or a heat transmission member.

Like in the transfer-fixing device 66L, in the transfer-fixing device 66N, the heating device 67N for heating the recording medium P immediately before the transfer-fixing process includes the heat transmission plate for guiding the recording medium P from the position near the registration roller pair 64 to the position near the nip N.

In the transfer-fixing device 66N, the metal layer 217*a* serving as a heat transmission plate or a heat transmission member covers the outer circumferential surface of the elastic roller 217 which rotates counterclockwise in FIG. 19 in a direction identical to the recording medium conveyance direction at the contact position at which the elastic roller 217 contacts the recording medium P. The brush roller 191' serving as a biasing member or a brush member opposes the metal layer 217*a* serving as a heat transmission plate or a heat transmission member. Like in the transfer-fixing device 66L, the brush roller 191' includes the flexible cylindrical member 191*c* serving as the outer circumferential surface of the brush roller 191' covering the bristles 191*b* depicted in FIG. 17.

The elastic roller 217 has a structure similar to the structure of the brush roller 191'. For example, the elastic roller 217 is a brush roller in which bristles (e.g., brush cloth) are wound around a core metal, and the metal layer 217*a* serving as a flexible cylindrical member covers the bristles. The metal layer 217*a*, that is, the cylindrical member covering the outer circumferential surface of the elastic roller 217 (e.g., the brush roller), is a metal belt including stainless steel having the thickness of about 0.1 mm.

In the transfer-fixing device 66N, the exciting coil 218 is used as a heating member for heating the elastic roller 217 or the metal layer 217*a* serving as a heat transmission plate or a heat transmission member. A power supply applies a high-frequency alternating voltage to the exciting coil 218 to heat the metal layer 217*a* by induction heating, improving heating efficiency for heating the metal layer 217*a*.

With this structure, when the recording medium P reaches a contact position at which the elastic roller 217 contacts the brush roller 191', rotation of the brush roller 191' and the elastic roller 217 sends the recording medium P out of the contact position toward the nip N formed between the transfer-fixing belt 27 and the pressing roller 68. In other words, the brush roller 191' and the elastic roller 217 guide and convey the recording medium P to the nip N smoothly. The elastic roller 217 contacts the brush roller 191' at an identical speed at the contact position to suppress wear of the elastic roller 217 and the brush roller 191' due to friction therebetween.

The elastic roller 217 and the brush roller 191' include flexible surfaces, respectively, which have a similar surface hardness. Accordingly, the elastic roller 217 and the brush roller 191' form a flat nip. Consequently, even when a thin recording medium P passes through the nip formed between the elastic roller 217 and the brush roller 191', the thin recording medium P which has passed through the nip is not curled by heat applied at the nip.

As described above, like in the embodiments illustrated in FIGS. 2 to 18, in the transfer-fixing device 66N, the heat transmission member (e.g., the metal layer 217*a*) heats the transfer-fixing side of the recording medium P while the heat transmission member guides the recording medium P to the nip N formed between the transfer-fixing member (e.g., the transfer-fixing belt 27) and the pressing member (e.g., the pressing roller 68). The brush member or the biasing member (e.g., the brush roller 191') presses or biases the recording medium P guided by the heat transmission member against the heat transmission member, thus reducing energy consumption, suppressing formation of a faulty fixed toner image or a toner image having uneven gloss, and providing proper fixing property.

Figure 20:
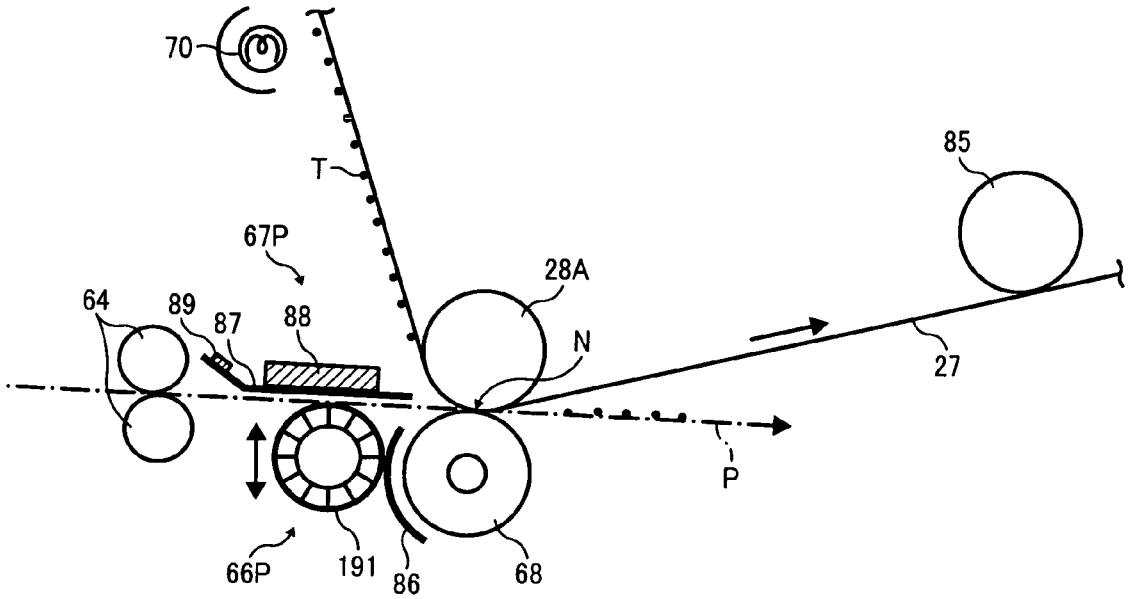
FIG. 20 is a sectional view of a transfer-fixing device according to yet another example embodiment.
Figure 21A:
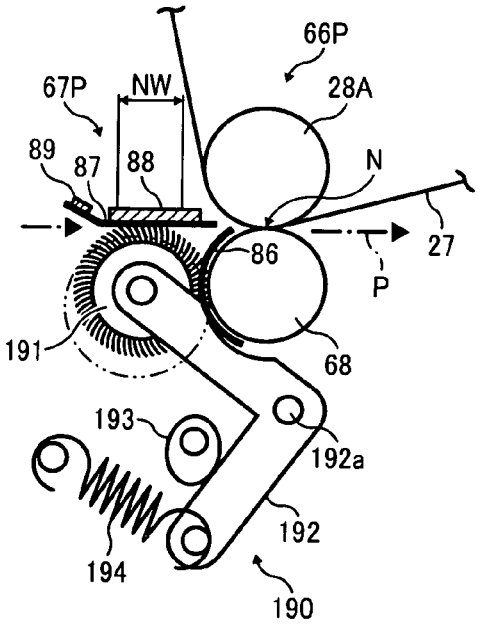
FIG. 21A is an enlarged sectional view (according to an example embodiment) of the transfer-fixing device shown in FIG. 20 when a biasing member included in the transfer-fixing device contacts a recording medium.
Figure 21B:
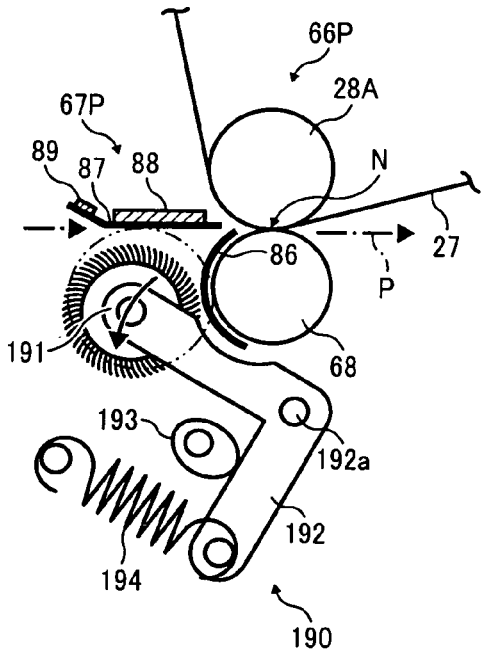
FIG. 21B is an enlarged sectional view (according to an example embodiment) of the transfer-fixing device shown in FIG. 21A when the biasing member is separated from the recording medium.
Figure 22:
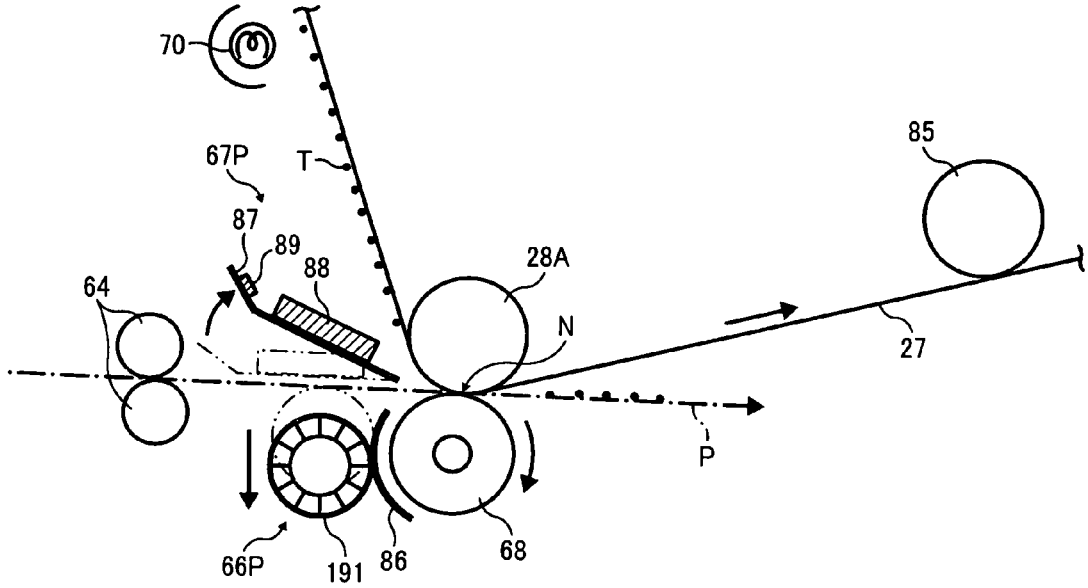
FIG. 22 is a sectional view (according to an example embodiment) of the transfer-fixing device shown in FIG. 20 when a biasing member and a heating device included in the transfer-fixing device are separated from a recording medium.

FIG. 20 is a sectional view of a transfer-fixing device 66P. FIGS. 21A and 21B illustrate a partially enlarged sectional view of the transfer-fixing device 66P. FIG. 22 is a sectional view of the transfer-fixing device 66P. As illustrated in FIGS. 20, 21A, 21B, and 22, the transfer-fixing device 66P includes a heating device 67P and a semi-cylindrical guide plate 86. The heating device 67P includes a heat transmission plate 87, a heating member 88, and a thermocouple 89. The heating device 67P replaces the heating device 67I depicted in FIGS. 13A and 13B. The other elements of the transfer-fixing device 66P are equivalent to the elements of the transfer-fixing device 66I depicted in FIGS. 13A and 13B.

The heating device 67P is provided at a position near an entrance to the nip N of the transfer-fixing device 66P. In the heating device 67P, the heating member 88 heats the heat transmission plate 87. The thermocouple 89 serves as a temperature detector for detecting the temperature of the heat transmission plate 87.

The plate-shaped heat transmission plate 87 has a plate thickness in a range from about 0.2 mm to about 1.5 mm and includes copper or aluminum. The heat transmission plate 87 extends from the position near the registration roller pair 64 to the position near the nip N, and serves as a guide plate for guiding the recording medium P to the nip N. The heat transmission plate 87 contacts the transfer-fixing side (e.g., the front side) of the recording medium P conveyed toward the nip N, and transmits heat generated by the heating member 88 to the transfer-fixing side of the recording medium P.

The heating member 88 has PTC character, and is adhered to a side of the heat transmission plate 87 opposite to a side facing the recording medium P. The heating member 88 having PTC character is a resistance heat generating member of which resistance sharply increases at a given Curie point. Accordingly, self temperature control function of the heating member 88 suppresses abnormal temperature increase of the heat transmission plate 87. For example, in the transfer-fixing device 66P, the temperature of the heat transmission plate 87 is controlled in a range from 180 degrees centigrade to 200 degrees centigrade.

The heat transmission plate 87 includes copper or aluminum which provides a high thermal conductivity at a relatively low cost, providing the heating device 67P having improved heating efficiency for heating the recording medium P at a relatively low cost.

The semi-cylindrical guide plate 86 covering the pressing roller 68 is provided between the brush roller 191 and the pressing roller 68 in the recording medium conveyance direction. A gap is provided between the semi-cylindrical guide plate 86 and the pressing roller 68 so that the semi-cylindrical guide plate 86 does not contact the pressing roller 68. Thus, the semi-cylindrical guide plate 86 prevents the brush roller 191 from contacting the pressing roller 68. For example, even when the brush roller 191 is provided close to the pressing roller 68, the semi-cylindrical guide plate 86 suppresses a side effect that the bristles of the brush roller 191 are entangled with the pressing roller 68. Accordingly, a distance (e.g., an idle running distance) between a pressing position at which the brush roller 191 presses against the heat transmission plate 87 and the nip N formed between the transfer-fixing belt 27 and the pressing roller 68 is shortened to improve heating efficiency for heating the recording medium P before the transfer-fixing process without the side effect.

In order to decrease slide resistance between the semi-cylindrical guide plate 86 and the brush roller 191 sliding over the semi-cylindrical guide plate 86, an outer circumferential surface of the semi-cylindrical guide plate 86 may be processed with wear-reduction surface finishing such as fluorocarbon resin coating. Further, in order to improve durability of the semi-cylindrical guide plate 86, the outer circumferential surface of the semi-cylindrical guide plate 86 may be covered with a high wear-resistant material such as diamond-like carbon (DLC).

As illustrated in FIGS. 21A and 21B, the transfer-fixing device 66P includes the lifting mechanism 190 serving as an adjuster for changing a biasing force applied by the brush roller 191 serving as a biasing member to the recording medium P to press the recording medium P against the heat transmission plate 87. As described above by referring to FIGS. 13A and 13B, change in a pressing width NW (e.g., a biasing force) of the brush roller 191 in which the brush roller 191 presses the recording medium P against the heat transmission plate 87 influences change in an amount of heat applied by the heat transmission plate 87 to the recording medium P.

Figure 23:
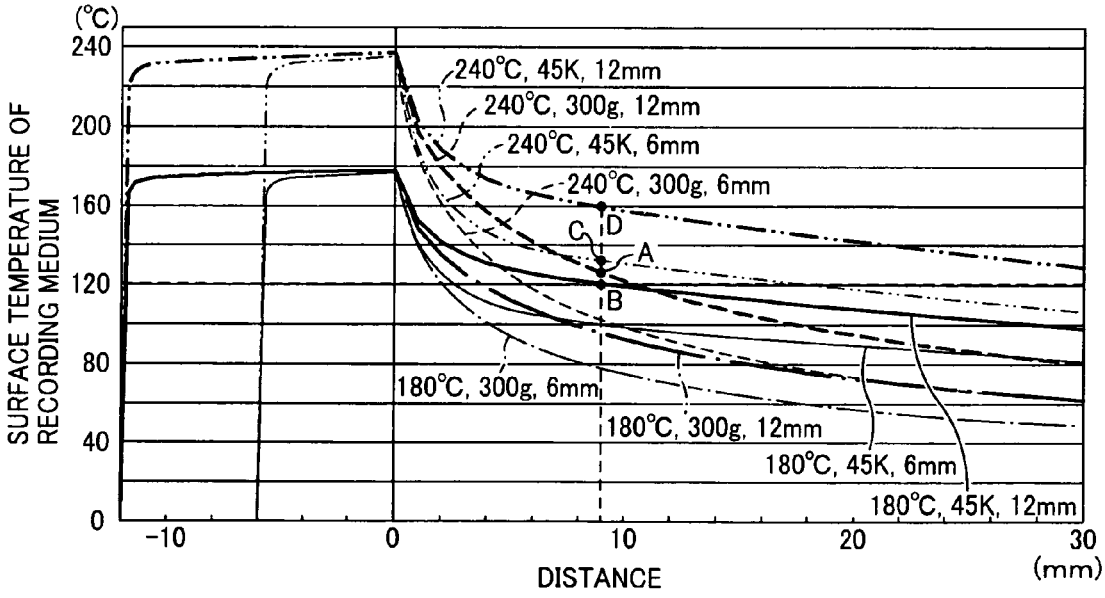
FIG. 23 is a graph (according to an example embodiment) showing a relation between a distance of idle running of a recording medium and the surface temperature of the recording medium.

FIG. 23 is a graph showing a relation between an idle running distance of the recording medium P from the heat transmission plate 87 to the nip N, that is, a contact position at which the transfer-fixing belt 27 contacts the pressing roller 68, and the surface temperature of the recording medium P, that is, the temperature of the transfer-fixing side of the recording medium P. The graph shows an analytical result of one-dimensional heat transmission analysis simulation using an implicit method.

In FIG. 23, the temperature of the heat transmission plate 87, the type of the recording medium P, and the pressing width NW (depicted in FIG. 21A) are mentioned in this order from left to right for each curve. Specifically, "300 g" represents thick paper and "45K" represents thin paper. The temperature of the heat transmission plate 87 is set to 240 degrees centigrade or 180 degrees centigrade. The type of the recording medium P is set to 300 g or 45K. The pressing width NW is set to 6 mm or 12 mm. The graph analyzes how much the temperature of the transfer-fixing side of the recording medium P decreases as the idle running distance from a heating position of the heat transmission plate 87 increases for each combination of the temperature of the heat transmission plate 87, the type of the recording medium P, and the pressing width NR.

The analytical result shown in FIG. 23 reveals that when 300 g paper, that is, thick paper, is used as a recording medium P, an amount of heat transmitted from the front side (e.g., the transfer-fixing side) to the back side of the recording medium P having a lower temperature is greater compared to when 45K paper, that is, thin paper, is used as a recording medium P. Accordingly, the greater the idle running distance, the greater the temperature decrease of the transfer-fixing side of the recording medium P. The greater the pressing width NW (e.g., a heating width), the smaller the temperature decrease of the transfer-fixing side of the recording medium P. Specifically, when the pressing width NW is great, heat is transmitted from the heat transmission plate 87 to an inner center portion of the recording medium P, and therefore temperature difference between the front side and the back side of the recording medium P becomes small. When the temperature of the heat transmission plate 87 is high, a great amount of heat is transmitted to the front side of the recording medium P. Accordingly, the temperature of the transfer-fixing side of the recording medium P increases after the idle running distance reaches a given value.

In order to maintain the surface temperature of the recording medium P at 120 degrees centigrade at a position corresponding to the idle running distance of 9 mm, when 300 g paper, that is, thick paper, is used as the recording medium P, the temperature of the heat transmission plate 87 needs to be 240 degrees centigrade and the pressing width NW needs to be about 12 mm as shown by point A in FIG. 23. By contrast, when 45K paper, that is, thin paper, is used as the recording medium P, even when the temperature of the heat transmission plate 87 is set to 180 degrees centigrade, the surface temperature of the recording medium P is maintained at 120 degrees centigrade at a position corresponding to the idle running distance of 9 mm as shown by point B in FIG. 23. Further, when 45K paper, that is, thin paper, is used as the recording medium P, when the temperature of the heat transmission plate 87 is set to 240 degrees centigrade even when the pressing width NW is smaller than 6 mm, the surface temperature of the recording medium P is maintained at 120 degrees centigrade at a position corresponding to the idle running distance of 9 mm as shown by point C in FIG. 23.

Accordingly, when 45K paper, that is, thin paper, used as the recording medium P is heated under an optimum condition for 300 g paper, that is, thick paper, in which the temperature of the heat transmission plate 87 is 240 degrees centigrade and the pressing width NW is 12 mm, the temperature of the transfer-fixing side of the recording medium P increases to 160 degrees centigrade. Thus, the difference between the temperature of the thin recording medium P and the temperature of the thick recording medium P may increase to about 40 degrees centigrade. In other words, when a heating condition determined to apply a minimum amount of heat to the thick recording medium P is applied to the thin recording medium P, the temperature of the thin recording medium P increases to a level beyond a proper temperature. Thus, an amount of heat greater than the minimum amount of heat necessary to heat the thin recording medium P is applied to the thin recording medium P, resulting in wasting energy. Moreover, excessive heat transmitted to the transfer-fixing belt 27 via the front side or the back side of the recording medium P may generate hot offset due to increase of the temperature of the transfer-fixing belt 27. Further, the temperature of the back side of the recording medium P increases beyond necessity for duplex printing, and a toner image on the recording medium P is melted again, resulting in degradation of the toner image and faulty heat cycle.

To address this problem, the pressing width NW of the brush roller 191 pressing against the heat transmission plate 87 is changed according to the thickness of the recording medium P to optimize the temperature of the transfer-fixing side of the recording medium P entering the nip N during the transfer-fixing process regardless of the thickness of the recording medium P. Further, the recording medium P is heated with a minimum amount of heat required to transfer and fix a toner image on the recording medium P properly, improving energy efficiency of the transfer-fixing device 66P. The thin recording medium P is heated with a minimum amount of heat to prevent the thin recording medium P from curling after the thin recording medium P is heated.

A thickness sensor may be provided on a conveyance path for conveying the recording medium P to detect the thickness of the recording medium P to be sent to the nip N. Alternatively, the thickness of the recording medium P may be judged based on information about the recording medium P input by the user on the control panel provided on the image forming apparatus 1 depicted in FIG. 1. The controller C depicted in FIG. 1 controls movement of the lifting mechanism 190 according to the information about the thickness of the recording medium P obtained as above.

In the transfer-fixing device 66P, the controller C controls the lifting mechanism 190 serving as an adjuster according to the thickness of the recording medium P to optimize the pressing width NR.

Alternatively, the controller C may control the lifting mechanism 190 according to an environmental temperature (e.g., an ambient temperature), an accumulated time of operation, the temperature of the heat transmission plate 87, or the like to optimize the pressing width NR.

For example, when the environmental temperature is low, the controller C may control the lifting mechanism 190 to provide the greater pressing width NW or the greater biasing force compared to when the environmental temperature is high. When the environmental temperature is low, the heat transmission plate 87 may not heat the recording medium P easily. To address this problem, the above-described control optimizes the temperature of the transfer-fixing side of the recording medium P entering the nip N during the transfer-fixing process regardless of the environmental temperature. A temperature sensor provided inside the image forming apparatus 1 may detect the environmental temperature.

The controller C may control the lifting mechanism 190 to increase the pressing width NW or the biasing force over time. A restoration force (e.g., a repulsive force) of the bristles of the brush roller 191 decreases over time compared to an initial state. Accordingly, the pressing width NW may change even when a position of the brush roller 191 is not changed with respect to the heat transmission plate 87. Consequently, the heat transmission plate 87 may not heat the recording medium P easily. To address this problem, the above-described control optimizes the temperature of the transfer-fixing side of the recording medium P over time. The controller C may determine an elapsed time based on a count provided by a counter for counting an accumulated number of prints provided in the image forming apparatus 1.

When the temperature of the heat transmission plate 87 is low, the controller C may control the lifting mechanism 190 to provide the greater pressing width NW or the greater biasing force compared to when the temperature of the heat transmission plate 87 is high. Including the above-described change of the environmental temperature, when the temperature of the heat transmission plate 87 is low, the heat transmission plate 87 may not heat the recording medium P easily. To address this problem, the above-described control optimizes the temperature of the transfer-fixing side of the recording medium P entering the nip N during the transfer-fixing process. The thermocouple 89 attached to the heat transmission plate 87 may detect the temperature of the heat transmission plate 87.

In the transfer-fixing device 66P, the controller C controls movement of the lifting mechanism 190 serving as a first adjuster according to the thickness or the like of the recording medium P to optimize the pressing width NR. Alternatively, the transfer-fixing device 66P may further include a second adjuster for adjusting the temperature of the heat transmission plate 87 to control movement of the lifting mechanism 190 according to the thickness or the like of the recording medium P so as to optimize the pressing width NW and the temperature of the heat transmission plate 87.

As described above by referring to FIG. 23, in addition to the pressing width NR, the temperature of the heat transmission plate 87 also influences optimization of the temperature of the transfer-fixing side of the recording medium P substantially. Accordingly, the temperature of the heat transmission plate 87 may be adjusted according to the thickness of the recording medium P or the like to optimize the temperature of the transfer-fixing side of the recording medium P entering the nip N during the transfer-fixing process. For example, a ceramic heater or a plate heater, of which temperature is easily adjusted, may be used as the heating member 88, and the temperature of the heating member 88 may be controlled based on the temperature detected by the thermocouple 89 so as to optimize the temperature of the heat transmission plate 87 according to the thickness or the like of the recording medium P.

In this case, the temperature of the heat transmission plate 87 may be adjusted according to the environmental temperature or the accumulated time of operation other than the thickness of the recording medium P.

FIG. 21B illustrates the brush roller 191 separated completely from the heat transmission plate 87 by the above-described movement of the lifting mechanism 190.

In the transfer-fixing device 66P, when the recording medium P does not pass through the transfer-fixing device 66P, that is, when the recording medium P does not pass between the heat transmission plate 87 and the brush roller 191, the brush roller 191 is separated relatively from the heat transmission plate 87 as illustrated in FIG. 21B. Accordingly, the brush roller 191 contacts the heat transmission plate 87 at a minimum time, reducing thermal degradation of the brush roller 191 due to heat transmitted from the heat transmission plate 87.

As illustrated in FIG. 22, in the transfer-fixing device 66P, when the recording medium P is jammed near the heat transmission plate 87, that is, when the recording medium P is stopped between the heat transmission plate 87 and the brush roller 191, the heat transmission plate 87 is moved in a direction in which the heat transmission plate 87 separates from the recording medium P or the conveyance path for conveying the recording medium P. For example, a driver including a solenoid moves the heat transmission plate 87 to positions illustrated in a solid line and a broken line in FIG. 22. Specifically, the heat transmission plate 87 rotates about a leading edge thereof. When a jam sensor detects the jammed recording medium P at a position near the heat transmission plate 87, heating by the heating member 88 is interrupted, and the heat transmission plate 87 moves to the position illustrated in the solid line in FIG. 22 and separates from the brush roller 191.

Accordingly, the jammed recording medium P does not continue contacting the heat transmission plate 87, and therefore is not overheated. Specifically, the jammed recording medium P is not overheated to an ignition point. Further, the heat transmission plate 87 restrains movement of the jammed recording medium P with a decreased restraint force, facilitating removal of the jammed recording medium P from the transfer-fixing device 66P by the user.

In addition to the above-described control for addressing the jammed recording medium P, the controller C moves the lifting mechanism 190 to the position illustrated in a solid line in FIG. 21B to separate the brush roller 191 from the conveyance path so as to further facilitate removal of the jammed recording medium P by the user.

In the transfer-fixing device 66P, the recording medium P and the transfer-fixing belt 27 may be heated in such a manner that the temperature of the transfer-fixing side of the recording medium P is greater than the surface temperature of the transfer-fixing belt 27 or a toner image T on the transfer-fixing belt 27. In this case, the toner image T on the transfer-fixing belt 27 is heated and melted mainly by heat received from the recording medium P at the nip N.

As described above, the heating device 67P and the heater 70 heat the recording medium P and the transfer-fixing belt 27, respectively, so that the temperature of the transfer-fixing side of the recording medium P is greater than the surface temperature of the transfer-fixing belt 27. Difference between viscoelasticity of an interface between toner of the toner image T and the recording medium P and viscoelasticity of an interface between toner of the toner image T and the transfer-fixing belt 27 prevents hot offset. Specifically, the temperature of a side of a toner layer of the toner image T facing the recording medium P is greater than the temperature of an opposite side of the toner layer facing the transfer-fixing belt 27. Accordingly, an adhesive force between the recording medium P and the toner image T is greater than an adhesive force between the transfer-fixing belt 27 and the toner image T to facilitate releasing of the toner from the transfer-fixing belt 27, resulting in formation of a high-quality toner image without offset to the transfer-fixing belt 27. Further, improved hot offset resistance reduces an amount of wax added to the toner to improve releasing property or does not require the wax, improving color reproduction, development, and charging properties. Further, when the temperature of the transfer-fixing belt 27 is low, the transfer-fixing belt 27 is cooled easily, reducing thermal degradation of the photoconductive drums 21 or the like contacting the transfer-fixing belt 27.

For example, in order to prevent offset, the following three formulas (1) to (3) may be satisfied. In the formulas (1) to (3), "Tt" represents the surface temperature of the toner image T on the transfer-fixing belt 27, which is heated by the heater 70, immediately before the toner image T enters the nip N. "Tp" represents the surface temperature of the transfer-fixing side of the recording medium P, which is heated by the heating device 67P, immediately before the recording medium P enters the nip N. "Tb" represents the temperature of the pressing roller 68. "Tfb" represents a flow start temperature of the toner. "Ts" represents a softening temperature of the toner.

$$(Tt+Tp)/2>Tfb \quad (1)$$

$$Tt<Tfb \quad (2)$$

(Preferably Tt<Tfb−20° C., More Preferably Tt<Tfb−30° C.)

$$Tb<Ts \quad (3)$$

The softening temperature and the flow start temperature of the toner may be measured using a flow tester model CFT500D manufactured by Shimadzu Corporation, that is, a capillary and slit die rheometer which measures viscosity or resistance of a molten material (e.g., toner) based on a flow rate at which a sample of the melt (e.g., toner) heated and melted from an environment in a cylinder is extruded through a capillary die under constant pressure applied downward by a piston. Thereafter, the melted toner is squeezed out of through a die provided with a narrow through-hole. The flow rate (e.g., molten viscosity) of the sample is determined based on the flow rate. For example, measurements may be carried out under the following conditions: pressure force of 5 kgf/cm$^2$; temperature rise rate of 3.0° C./min; die diameter of 1.00 mm; and die length of 10.0 mm.

Figure 24A:
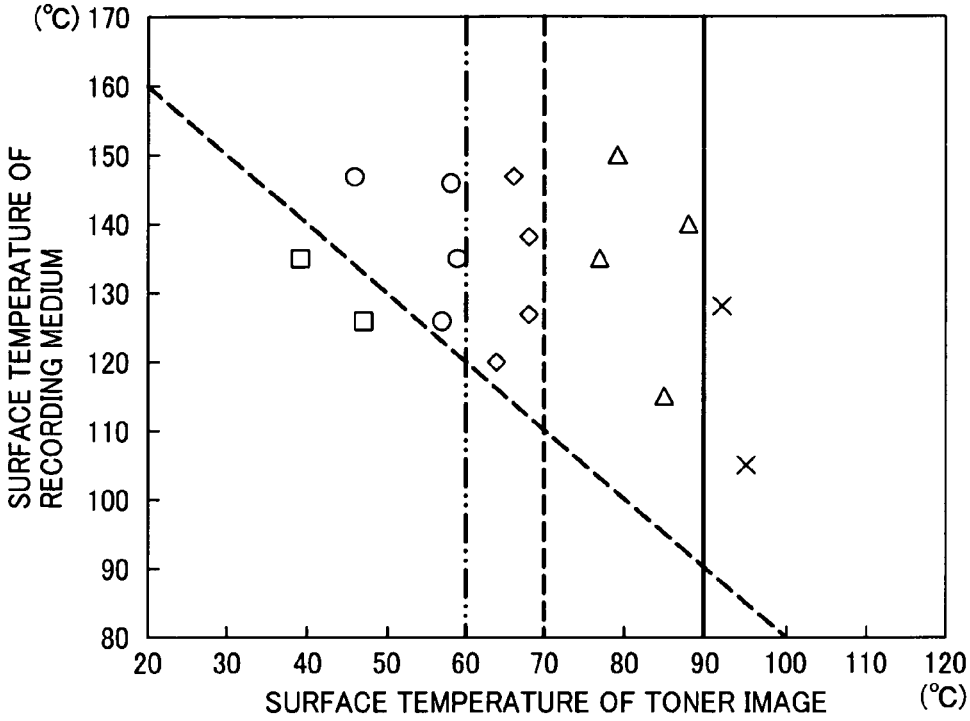
FIG. 24A is a graph (according to an example embodiment) showing an experimental result when toner having a flow start temperature of 90 degrees centigrade is used.
Figure 24B:
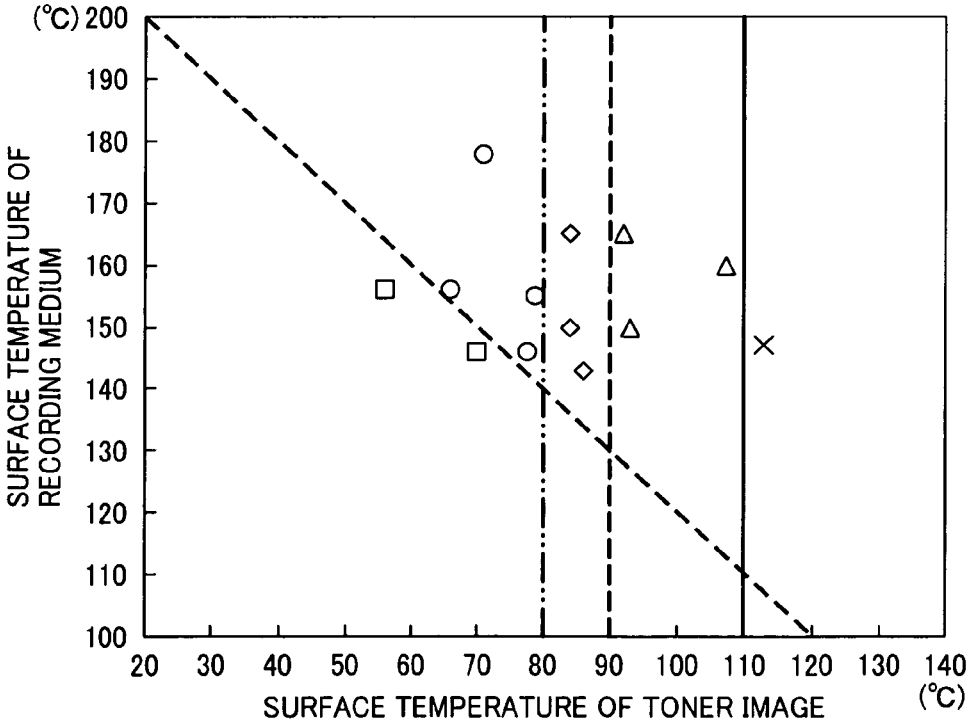
FIG. 24B is a graph (according to an example embodiment) showing an experimental result when toner having a flow start temperature of 110 degrees centigrade is used.

FIGS. 24A and 24B illustrate a graph showing experimental results supporting the above three formulas (1) to (3).

In an experiment, the surface temperature Tt of the toner image T on the transfer-fixing belt 27 heated by the heater 70 immediately before the transfer-fixing belt 27 enters the nip N, which is represented by a horizontal axis in FIGS. 24A and 24B, and the surface temperature Tp of the recording medium P heated by the heating device 67P immediately before the recording medium P enters the nip N, which is represented by a vertical axis in FIGS. 24A and 24B, are changed to observe fixing property (e.g., generation of offset) of the fixed toner image. FIG. 24A shows an experimental result when the toner having the flow start temperature Tfb of 90 degrees centigrade was used. FIG. 24B shows an experimental result when the toner having the flow start temperature Tfb of 110 degrees centigrade was used. In the experiment, coated paper model Casablanca X manufactured by Oji Paper Co., Ltd. having a basic weight of 100 g/m$^2$ was used as the recording medium P. A nip time at which the recording medium P passed through the nip N was 50 ms, and a pressure applied to the recording medium P at the nip N was 2 kgf/m$^2$. In FIGS. 24A and 24B, ○ denotes proper fixing, ◇ denotes very slight hot offset, Δ denotes slight hot offset, X denotes unallowable hot offset, and □ denotes cold offset. In FIGS. 24A and 24B, an oblique line illustrated in a broken line denotes a lower limit fixing temperature to provide proper fixing property. A region above the broken line provides proper fixing property.

FIGS. 24A and 24B show that when the temperature Tt of the toner image T immediately before the toner image T enters the nip N is greater than the flow start temperature Tfb of the toner (e.g., Tfb<Tt) in the region above the lower limit fixing temperature, hot offset generates, and therefore a proper toner image is not formed. To address this problem, the heating device 67P is configured to perform proper temperature control to satisfy the above formulas (1) and (2) so as to form a proper toner image on which offset hardly generates. Further, FIGS. 24A and 24B show that when the formula Tfb−Tt≧20° C. is satisfied, an amount of hot offset decreases further, and when the formula Tfb−Tt≧30° C. is satisfied, hot offset does not generate substantially completely.

The above formula (3) regulates the temperature of the pressing roller 68 forming the nip N by pressing against the transfer-fixing belt 27 to a level not greater than the softening temperature of the toner, thus reducing difference between gloss of the toner image on the front side (e.g., the first side) of the recording medium P and gloss of the toner image on the back side (e.g., the second side) of the recording medium P during duplex printing.

As described above, in the transfer-fixing device 66P, the heat transmission member (e.g., the heat transmission plate 87) heats the transfer-fixing side of the recording medium P while the heat transmission member guides the recording medium P to the nip N formed between the transfer-fixing member (e.g., the transfer-fixing belt 27) and the pressing member (e.g., the pressing roller 68). The brush member or the biasing member (e.g., the brush roller 191) presses or biases the recording medium P against the heat transmission member, and the biasing force (e.g., the pressing width NW) of the brush roller 191 is changeable, thus reducing energy consumption. Even when recording media P of various thicknesses pass through the transfer-fixing device 66P or the environmental temperature changes, the heat transmission plate 87 heats the recording medium P immediately before the transfer-fixing process stably, forming a properly-fixed, high-quality toner image.

In the transfer-fixing device 66P, the transfer-fixing belt 27 is used as a transfer-fixing member. Alternatively, a transfer-fixing roller may be used as a transfer-fixing member.

In the transfer-fixing device 66P, the equalization roller 85 is used as a cooling member for cooling the transfer-fixing belt 27 after the transfer-fixing process. Alternatively, a cooling fan facing the surface of the transfer-fixing belt 27 may be used as a cooling member to provide effects equivalent to the effects provided by the transfer-fixing device 66P.

Figure 25:
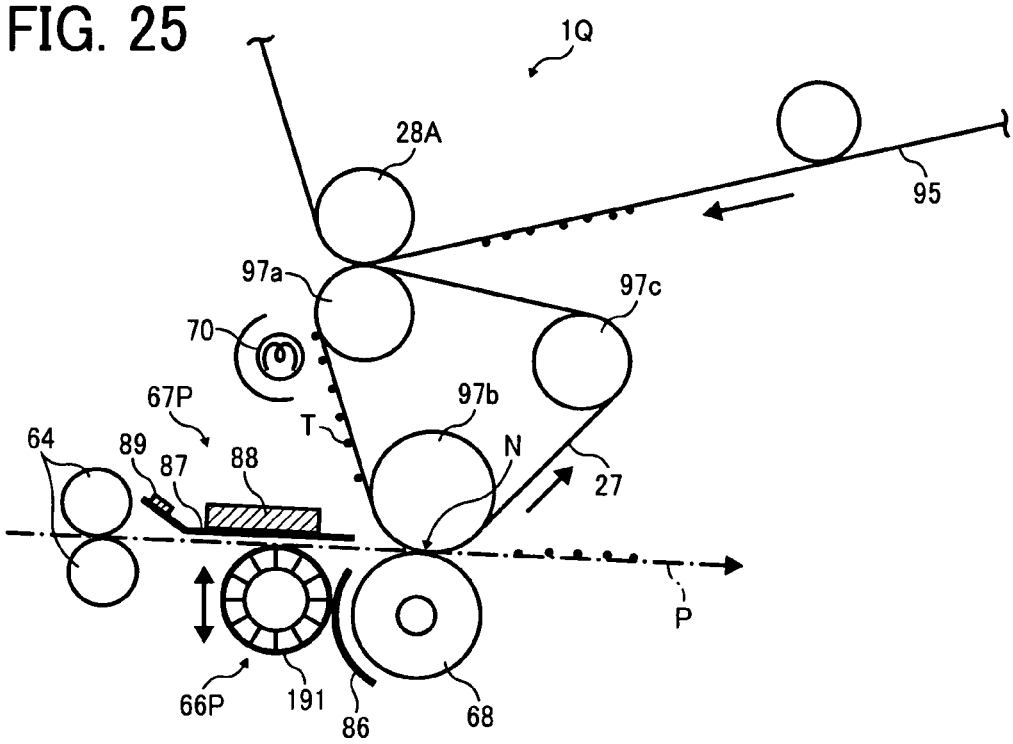
FIG. 25 is a partially schematic view of an image forming apparatus according to yet another example embodiment.

FIG. 25 is a partially schematic view of an image forming apparatus 1Q. As illustrated in FIG. 25, the image forming apparatus 1Q includes an intermediate transfer belt 95 and rollers 97*a*, 97*b*, and 97*c*. The other elements of the image forming apparatus 1Q are equivalent to the elements of the image forming apparatus 1 depicted in FIG. 1.

Unlike in the image forming apparatus 1 in which toner images formed on the photoconductive drums 21, respectively, are first-transferred onto the transfer-fixing belt 27, and then second-transferred onto a recording medium P, in the image forming apparatus 1Q, toner images formed on the photoconductive drums 21, respectively, are first-transferred onto the intermediate transfer belt 95, second-transferred onto the transfer-fixing belt 27, and then third-transferred onto a recording medium P.

In the image forming apparatus 1Q, yellow, magenta, cyan, and black toner images formed on the photoconductive drums 21, respectively, arranged to oppose the intermediate transfer belt 95 are first-transferred and superimposed onto the intermediate transfer belt 95 to form a color toner image. Thereafter, the color toner image is second-transferred onto the transfer-fixing belt 27 at a nip formed between the intermediate transfer belt 95 and the transfer-fixing belt 27 looped over the rollers 97*a*, 97*b*, and 97*c*. Then, the color toner image T is third-transferred and fixed onto a recording medium P at the nip N formed between the transfer-fixing belt 27 and the pressing roller 68.

Like in the image forming apparatus 1, in the image forming apparatus 1Q, the heating device 67P is provided at the position near the nip N to heat the recording medium P immediately before the transfer-fixing process. The brush roller 191 serving as a biasing member presses or biases the recording medium P against the heat transmission plate 87 immediately before the transfer-fixing process. The lifting mechanism 190 depicted in FIGS. 21A and 21B may be provided to change a contact force of the brush roller 191 with which the brush roller 191 contacts the heat transmission plate 87.

As described above, like in the embodiments illustrated in FIGS. 2 to 22, in the image forming apparatus 1Q, the heat transmission member (e.g., the heat transmission plate 87) heats the transfer-fixing side of the recording medium P while the heat transmission member guides the recording medium P to the nip N formed between the transfer-fixing member (e.g., the transfer-fixing belt 27) and the pressing member (e.g., the pressing roller 68). The brush member or the biasing member (e.g., the brush roller 191) presses or biases the recording medium P against the heat transmission member, and the biasing force (e.g., the pressing width NW) of the brush member is changeable, thus reducing energy consumption. Even when recording media P of various thicknesses pass through the transfer-fixing device 66P or the environmental temperature changes, the heat transmission member heats the recording medium P immediately before the transfer-fixing process stably, forming a properly-fixed, high-quality toner image.

Figure 26:
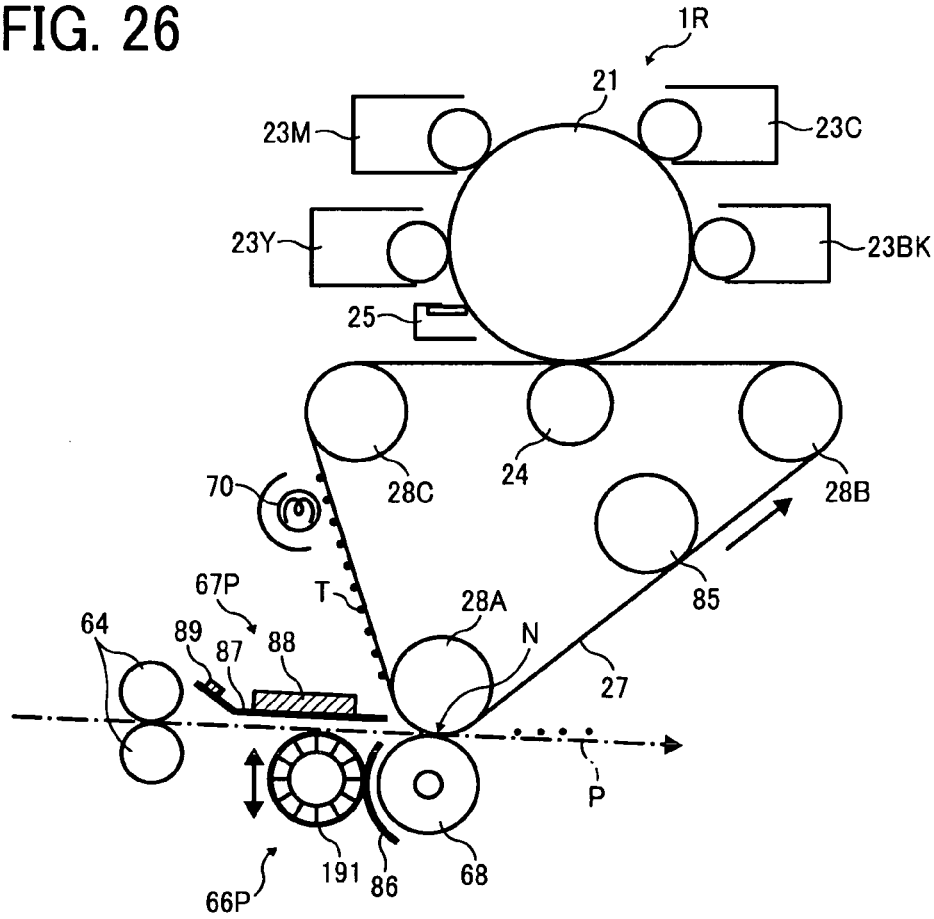
FIG. 26 is a partially schematic view of an image forming apparatus according to yet another example embodiment.

FIG. 26 is a partially schematic view of an image forming apparatus 1R. As illustrated in FIG. 26, the image forming apparatus 1R includes the transfer-fixing device 66P replacing the transfer-fixing device 66 depicted in FIG. 11, the heater 70, and the semi-cylindrical guide plate 86. The other elements of the image forming apparatus 1R are equivalent to the elements of the image forming apparatus 1H depicted in FIG. 11.

Like in the embodiments illustrated in FIGS. 2 to 25, in the image forming apparatus 1R, the heating device 67P is provided at the position near the nip N to heat the recording medium P immediately before the transfer-fixing process. The brush roller 191 serving as a biasing member presses or biases the recording medium P against the heat transmission plate 87 immediately before the transfer-fixing process. The lifting mechanism 190 depicted in FIGS. 21A and 21B may be provided to change a contact force of the brush roller 191 with which the brush roller 191 contacts the heat transmission plate 87.

As described above, like in the embodiments illustrated in FIGS. 2 to 25, in the image forming apparatus 1R, the heat transmission member (e.g., the heat transmission plate 87) heats the transfer-fixing side of the recording medium P while the heat transmission member guides the recording medium P to the nip N formed between the transfer-fixing member (e.g., the transfer-fixing belt 27) and the pressing member (e.g., the pressing roller 68). The brush member or the biasing member (e.g., the brush roller 191) presses or biases the recording medium P against the heat transmission member, and the biasing force (e.g., the pressing width NW) of the brush member is changeable, thus reducing energy consumption. Even when recording media P of various thicknesses pass through the transfer-fixing device 66P or the environmental temperature changes, the heat transmission member heats the recording medium P immediately before the transfer-fixing process stably, forming a properly-fixed, high-quality toner image.

The present invention has been described above with reference to specific example embodiments. Nonetheless, the present invention is not limited to the details of example embodiments described above, but various modifications and improvements are possible without departing from the spirit and scope of the present invention. It is therefore to be understood that within the scope of the associated claims, the present invention may be practiced otherwise than as specifically described herein. For example, elements and/or features of different illustrative example embodiments may be combined with each other and/or substituted for each other within the scope of the present invention.

What is claimed is:

1. A transfer-fixing device for transferring and fixing a toner image on a transfer-fixing side of a recording medium, comprising:

a transfer-fixing member to carry the toner image;

a pressing member to press against the transfer-fixing member to form a nip between the transfer-fixing member and the pressing member through which the recording medium passes;

a heat transmission member provided upstream from the nip in a recording medium conveyance direction to heat the transfer-fixing side of the recording medium while guiding the recording medium to the nip;

a heating member connected to the heat transmission member to heat the heat transmission member;

a biasing member to bias the recording medium guided by the heat transmission member against the heat transmission member, the biasing member includes a brush member to contact the recording medium guided by the heat transmission member; and a plate member provided between the brush member and the pressing member to prevent bristles of the brush member from being caught between the transfer-fixing member and the pressing member.

2. The transfer-fixing device according to claim 1, wherein the brush member includes at least one brush roller to contact the recording medium and rotate in a direction identical to the recording medium conveyance direction at a contact position at which the at least one brush roller contacts the recording medium.

3. The transfer-fixing device according to claim 2, wherein the at least one brush roller rotates at a circumferential velocity not smaller than a recording medium conveyance speed at the contact position at which the at least one brush roller contacts the recording medium.

4. The transfer-fixing device according to claim 1, further comprising a lifting mechanism connected to the biasing member to control a biasing force applied by the biasing member to the recording medium, wherein the lifting mechanism changes the biasing force according to thickness or type of the recording medium guided by the heat transmission member.

5. An image forming apparatus comprising the transfer-fixing device according to claim 1.

6. A transfer-fixing device for transferring and fixing a toner image on a transfer-fixing side of a recording medium, comprising:

a transfer-fixing member to carry the toner image;

a pressing member to press against the transfer-fixing member to form a nip between the transfer-fixing member and the pressing member through which the recording medium passes;

a heat transmission member provided upstream from the nip in a recording medium conveyance direction to heat the transfer-fixing side of the recording medium while guiding the recording medium to the nip;

a heating member connected to the heat transmission member to heat the heat transmission member;

a biasing member to bias the recording medium guided by the heat transmission member against the heat transmission member, the biasing member includes a brush member to contact the recording medium guided by the heat transmission member, wherein the brush member includes at least one brush roller to contact the recording medium and rotate in a direction identical to the recording medium conveyance direction at a contact position at which the at least one brush roller contacts the recording medium, and a cleaner slidably contactable against bristles of the at least one brush roller to clean the at least one brush roller.

7. A transfer-fixing device for transferring and fixing a toner image on a transfer-fixing side of a recording medium, comprising:

a transfer-fixing member to carry the toner image;

a pressing member to press against the transfer-fixing member to form a nip between the transfer-fixing member and the pressing member through which the recording medium passes;

a heat transmission member provided upstream from the nip in a recording medium conveyance direction to heat the transfer-fixing side of the recording medium while guiding the recording medium to the nip;

a heating member connected to the heat transmission member to heat the heat transmission member;

a biasing member to bias the recording medium guided by the heat transmission member against the heat transmission member, the biasing member includes a brush member to contact the recording medium guided by the heat transmission member, wherein the brush member includes at least one brush roller to contact the recording medium and rotate in a direction identical to the recording medium conveyance direction at a contact position at which the at least one brush roller contacts the recording medium, and wherein the at least one brush roller includes a flexible cylindrical member to cover an outer circumferential surface of the at least one brush roller.

8. The transfer-fixing device according to claim 7, wherein the cylindrical member includes a low-friction material.

9. The transfer-fixing device according to claim 7, further comprising a heating assembly disposed facing the cylindrical member to heat the cylindrical member.

10. The transfer-fixing device according to claim 7, further comprising an elastic roller to press against the recording medium and rotate in a direction identical to the recording medium conveyance direction, wherein the heat transmission member includes a metal layer covering an outer circumferential surface of the elastic roller.

11. A transfer-fixing device for transferring and fixing a toner image on a transfer-fixing side of a recording medium, comprising:

a transfer-fixing member to carry the toner image;

a pressing member to press against the transfer-fixing member to form a nip between the transfer-fixing member and the pressing member through which the recording medium passes;

a heat transmission member provided upstream from the nip in a recording medium conveyance direction to heat the transfer-fixing side of the recording medium while guiding the recording medium to the nip;

a heating member connected to the heat transmission member to heat the heat transmission member; and a biasing member to bias the recording medium guided by the heat transmission member against the heat transmission member, wherein the biasing member includes a vacuum mechanism disposed facing a side of the heat transmission member opposite a side of the heat transmission member facing the recording medium to exert a vacuum force on the recording medium guided by the heat transmission member via through-holes provided in the heat transmission member.

12. A transfer-fixing device for transferring and fixing a toner image on a transfer-fixing side of a recording medium, comprising:

a transfer-fixing member to carry the toner image;

a pressing member to press against the transfer-fixing member to form a nip between the transfer-fixing member and the pressing member through which the recording medium passes;

a heat transmission member provided upstream from the nip in a recording medium conveyance direction to heat the transfer-fixing side of the recording medium while guiding the recording medium to the nip;

a heating member connected to the heat transmission member to heat the heat transmission member; and a biasing member to bias the recording medium guided by the heat transmission member against the heat transmission member, the biasing member includes a brush member to contact the recording medium guided by the heat transmission member, wherein the brush member includes hollow bristles through which air is directed onto the recording medium guided by the heat transmission member.

13. The transfer-fixing device according to claim 12, wherein the biasing member biases a leading edge and a trailing edge of the recording medium guided by the heat transmission member in the recording medium conveyance direction against the heat transmission member.

14. The transfer-fixing device according to claim 12, further comprising a controller to adjust a conveyance speed of the recording medium, wherein the heat transmission member includes a curved guide surface portion having a convex shape facing the recording medium guided by the heat transmission member, and wherein the controller adjusts the conveyance speed of the recording medium at a position upstream from the curved guide surface portion in the recording medium conveyance direction to be smaller than the conveyance speed of the recording medium at a position at which the recording medium contacts the curved guide surface portion.

15. The transfer-fixing device according to claim 12, further comprising a controller to adjust a conveyance speed of the recording medium, wherein the heat transmission member includes a curved guide surface portion having a concave shape facing the recording medium guided by the heat transmission member, and wherein the controller adjusts the conveyance speed of the recording medium at a position upstream from the curved guide surface portion in the recording medium conveyance direction to be greater than the conveyance speed of the recording medium at a position at which the recording medium contacts the curved guide surface portion.

16. A transfer-fixing device for transferring and fixing a toner image on a transfer-fixing side of a recording medium, comprising:

a transfer-fixing member to carry the toner image;

a pressing member to press against the transfer-fixing member to form a nip between the transfer-fixing member and the pressing member through which the recording medium passes;

a heat transmission member provided upstream from the nip in a recording medium conveyance direction to heat the transfer-fixing side of the recording medium while guiding the recording medium to the nip;

a heating member connected to the heat transmission member to heat the heat transmission member; and a biasing member to bias the recording medium guided by the heat transmission member against the heat transmission member, the biasing member includes a brush member to contact the recording medium guided by the heat transmission member, wherein the brush member includes at least one brush roller to contact the recording medium and rotate in a direction identical to the recording medium conveyance direction at a contact position at which the at least one brush roller contacts the recording medium, and further includes a guide provided upstream from the at least one brush roller in the recording medium conveyance direction to contact bristles of the at least one brush roller and guide the recording medium to the biasing member.

17. The transfer-fixing device according to claim 16, wherein the at least one brush roller is slidably contactable against the pressing member.

* * * * *